US009120141B2

(12) United States Patent
Clew et al.

(10) Patent No.: US 9,120,141 B2
(45) Date of Patent: Sep. 1, 2015

(54) FASTENER DISPENSING APPARATUS

(75) Inventors: Nicholas R. Clew, Farmington Hills, MI (US); Wojciech Gostylla, Queensland (AU); Stuart E. Blacket, Queensland (AU)

(73) Assignee: Henrob Limited, Flintshire (GB)

( * ) Notice: Subject to any disclaimer, the term of this patent is extended or adjusted under 35 U.S.C. 154(b) by 492 days.

(21) Appl. No.: 13/508,928

(22) PCT Filed: Oct. 22, 2010

(86) PCT No.: PCT/GB2010/001957

§ 371 (c)(1),
(2), (4) Date: May 9, 2012

(87) PCT Pub. No.: WO2011/058297

PCT Pub. Date: May 19, 2011

(65) Prior Publication Data

US 2012/0227256 A1 Sep. 13, 2012

Related U.S. Application Data

(60) Provisional application No. 61/260,151, filed on Nov. 11, 2009.

(51) Int. Cl.
*B25C 7/00* (2006.01)
*B27F 7/00* (2006.01)
(Continued)

(52) U.S. Cl.
CPC ..... *B21J 15/323* (2013.01); *Y10T 29/49956* (2013.01); *Y10T 29/53513* (2015.01)

(58) Field of Classification Search
CPC ..... B21J 15/323; Y10T 29/49956; Y10T 29/53513
USPC ..... 29/798, 432, 432.1, 432.2, 525.01, 816, 29/818, 243.5, 811.2, 525.05, 525.06, 29/34 B; 227/15, 18, 136, 138
See application file for complete search history.

(56) References Cited

U.S. PATENT DOCUMENTS 3,930,297 A * 1/1976 Potucek et al. ..... 29/431
4,014,488 A 3/1977 Potucek et al.
(Continued)

FOREIGN PATENT DOCUMENTS

DE 19704480 8/1998
DE 202006016368 1/2007
(Continued)

OTHER PUBLICATIONS

International Search Report dated Feb. 15, 2011 of PCT/GB2010/001957, filed Oct. 22, 2010.
(Continued)

*Primary Examiner* — Essama Omgba
*Assistant Examiner* — Darrell C Ford
(74) *Attorney, Agent, or Firm* — Michael Best & Friedrich LLP

(57) ABSTRACT

A fastener dispensing apparatus includes a body that defines a punch path and at least partially surrounds a punch that includes forward and rearward portions. The punch reciprocates between retracted and advanced positions in which the tip of the forward portion extends from an end of the punch path to drive a fastener towards the workpiece. A fastener feed path extends transverse to the punch path and is defined by a surface of the body, the fastener feed path receives an elongate carrier of fasteners. A fastener feeding device sequentially feeds fasteners along the fastener feed path and into alignment with the end of the punch path. An actuator is drivable by the reciprocal movement of the rearward portion of the punch. An engagement member engages the carrier and is moveable relative to the body.

36 Claims, 19 Drawing Sheets

(51) Int. Cl.

| | |
|---|---|
| ***B23P 11/00*** | (2006.01) |
| ***B23P 17/00*** | (2006.01) |
| ***B21J 15/02*** | (2006.01) |
| ***B21J 15/00*** | (2006.01) |
| ***B23Q 7/10*** | (2006.01) |
| ***B21J 15/32*** | (2006.01) |

(56) References Cited

U.S. PATENT DOCUMENTS

| | | | | | |
|---|---|---|---|---|---|
| 4,089,099 | A | * | 5/1978 | Nivet | 29/811.2 |
| 4,119,258 | A | * | 10/1978 | Ewig, Jr. | 227/132 |
| 4,146,071 | A | * | 3/1979 | Mueller et al. | 81/434 |
| 4,404,742 | A | * | 9/1983 | Fuhrmeister | 29/798 |
| 4,535,925 | A | * | 8/1985 | Ramey et al. | 227/55 |
| 4,615,475 | A | * | 10/1986 | Fuhrmeister | 227/136 |
| 5,123,162 | A | * | 6/1992 | Wing et al. | 29/818 |
| 5,327,639 | A | * | 7/1994 | Wing et al. | 29/709 |
| 5,351,392 | A | * | 10/1994 | Wing et al. | 29/818 |
| 5,590,459 | A | * | 1/1997 | Ohuchi et al. | 29/809 |
| 5,619,788 | A | * | 4/1997 | Schmidt | 29/798 |
| 5,779,127 | A | | 7/1998 | Blacket et al. | |
| 5,934,162 | A | * | 8/1999 | Habermehl | 81/434 |
| 5,943,926 | A | * | 8/1999 | Habermehl | 81/434 |
| 5,964,393 | A | * | 10/1999 | Feldpausch et al. | 227/135 |
| 6,089,437 | A | * | 7/2000 | Blacket et al. | 227/136 |
| 6,098,442 | A | * | 8/2000 | Walldorf et al. | 72/391.6 |
| 6,148,507 | A | * | 11/2000 | Swanson et al. | 29/816 |
| 6,381,821 | B1 | * | 5/2002 | Panyon, Jr. | 29/33 R |
| 6,439,085 | B1 | | 8/2002 | Habermehl et al. | |
| 6,592,015 | B1 | * | 7/2003 | Gostylla et al. | 227/112 |
| 6,655,573 | B1 | * | 12/2003 | Chang et al. | 227/109 |
| 6,944,944 | B1 | * | 9/2005 | Craythorn et al. | 29/798 |
| 7,043,827 | B2 | * | 5/2006 | Ohuchi et al. | 29/823 |
| 8,256,104 | B2 | * | 9/2012 | Fulbright | 29/818 |
| 8,887,364 | B2 | * | 11/2014 | Kikuchi | 29/243.53 |
| 2005/0072276 | A1 | | 4/2005 | Lin | |
| 2005/0081373 | A1 | * | 4/2005 | Seidler | 29/811.2 |
| 2011/0049176 | A1 | * | 3/2011 | Craythorn et al. | 221/1 |
| 2013/0042471 | A1 | * | 2/2013 | Kikuchi | 29/811.2 |

FOREIGN PATENT DOCUMENTS

| | | |
|---|---|---|
| EP | 0166303 | 1/1986 |
| EP | 0593970 | 4/1994 |
| JP | S50-074899 | 6/1975 |
| JP | S61-014866 | 1/1986 |
| JP | H06-126646 | 5/1994 |
| WO | 9309918 | 5/1993 |

OTHER PUBLICATIONS

English translation of Notice of Reasons for Rejection from the Japan Patent Office for Application No. 2012-538391 dated Aug. 28, 2014 (8 pages).

* cited by examiner

FASTENER DISPENSING APPARATUS

CROSS REFERENCE TO RELATED APPLICATIONS

This application is a national phase application of PCT Application No. PCT/GB2010/001957, filed Oct. 22, 2010 which claims priority to U.S. Patent Application No. 61/260,151, filed Nov. 11, 2009, the entire contents of which are hereby incorporated by reference therein.

BACKGROUND

The present invention relates to fastener dispensing apparatus having a fastener feeding device for feeding fasteners into the path of a punch of the apparatus, the punch being drivable to dispense a fastener and optionally insert it into a workpiece.

The term "fastener" is used here to include, for example, rivets, screws, slugs and other types of fasteners. The term "punch" is used here to include any appropriate component of a fastener insertion apparatus which inserts such fasteners into a workpiece.

SUMMARY

A fastener insertion apparatus, such as a punch riveter, is commonly used in the construction of a wide variety of workpieces, such as white goods and automobiles. The fastener insertion apparatus includes a reciprocally translating punch and a feeding device which feeds fasteners into the path of the punch. Such fastener insertion apparatus are often used in large scale continuous production lines over long periods of time. It is therefore desirable that the fastener insertion apparatus is equipped with a feeding device capable of reliably providing a large supply of fasteners into the path of the punch.

It is desirable that a feeding device functions reliably so as to avoid errors, such as a fastener not being supplied to the fastener insertion apparatus when expected or a fastener being incorrectly fed into the path of the punch. Such errors can result in a halt in production, in the fastener insertion apparatus incorrectly fastening workpieces together, or in damage to either the workpieces or the fastener itself.

A halt in production is a costly delay in itself. However, damage to the feeding device or the fastener insertion apparatus can be a particularly problematic cause of delays because the machines must be taken offline so as to be repaired. In the case of a production line this requires shutting down production for a time, at a significant cost. The feeding device and fastener insertion apparatus should therefore function reliably and robustly in order to reduce the likelihood of delays due to the need to repair or replace them.

Fasteners are often fed into fastener insertion apparatus supported in an elongate flexible carrier such as a tape. The tape comprises a number of spaced apart holes along its length, into which fasteners are inserted and is fed into the path of the punch so that, the punch sequentially drives each fastener from the tape and inserts it into a workpiece.

In such a tape-fed fastener insertion apparatus, the feeding device feeds the tape through the fastener insertion apparatus so that each fastener in the tape becomes aligned with the path of the punch and is inserted by the punch into a workpiece which is being fastened. A common solution to the problem of timing movement of the tape during a fastener insertion cycle is to use the reciprocal movement of the punch to drive the feeding device.

In one such example, a punch-driven rivet insertion apparatus described in a PCT patent application published as WO 93/09918 incorporates a guide bush, within which a punch travels, a punch-driven index wheel which feeds a tape of rivets through the apparatus, and a nose piece which is pressed against a workpiece into which a rivet is to be inserted. During a rivet insertion cycle, the punch emerges from an end of the guide bush and travels through a cavity defined through the centre of the index wheel. After the punch passes through the cavity, it drives a rivet from the tape, through the nose piece and into the workpiece. As the punch drives the rivet into the workpiece, a rearward portion of the punch engages the index wheel, causing the index wheel to rotate. Rotation of the index wheel by the punch causes the wheel to index along the tape. The index wheel is biased by a torsion spring so that, when the punch retracts, the index wheel rotates back to its original position. The return motion of the wheel feeds the tape further through the apparatus, feeding the next rivet on the tape into the path of the punch. In some commercial embodiments the function of the torsion spring is fulfilled by a stripper spring, which is primarily used in the apparatus to bias the nose piece away from the punch as the punch is retracted at the end of a rivet insertion cycle. This double function of the stripper spring is achieved by providing a push rod between the stripper spring and the index wheel.

One problem with the above described apparatus is that the punch is unsupported as it travels through the cavity defined in the index wheel. As a result, should the punch drive an incorrectly aligned rivet against the nose piece, shear stresses may be imparted to the punch that can potentially cause damage.

A further problem is that, as the punch retracts, it can catch the next rivet on the tape "lifting" the rivet from the tape sufficiently to dislodge it. Thus, when that rivet is fed into the path of the punch, and subsequently punched, it is misaligned and causes a jam, or even damage to the apparatus. This is particularly a problem with short rivets as they can be lifted out of the tape carrier completely.

It is an object of the present invention to obviate or mitigate at least some of the problems outlined above. An alternative object is to provide for improved or alternative fastener insertion apparatus According to a first aspect of the present invention there is provided fastener dispensing apparatus for dispensing fasteners comprising: a body in which a punch path is defined; a punch at least partially within the punch path, the punch being reciprocally moveable between a retracted position and an advanced position in which it extends from an end of the punch path in order to drive a fastener towards a dispensed position; a fastener feed path extending transverse to the punch path, the fastener feed path being arranged for receipt of an elongate carrier of fasteners; and a fastener feeding device for feeding the elongate carrier along the fastener feed path such that fasteners are sequentially brought into alignment with the end of the punch path, the fastener feeding device comprising an actuator moveable relative to the body by the reciprocal movement of the punch and at least one engagement member for engaging the elongate carrier or a fastener in the carrier, the at least one engagement member being moveable relative to the body in response to movement of the actuator.

The movement of the punch, which is typically in a rectilinear direction, between the retracted and advanced positions thus effects feeding of the elongate carrier so as to bring the next fastener into line with the punch path. The movement of the at least one engagement member relative to the body in which the punch path is defined provides for apparatus that is reliable and compact.

The actuator may be provided within the body and may be moveable by contact with a part of the punch at an appropriate point in its reciprocation in the punch path. The actuator may be coupled directly or indirectly to the at least one engagement member. The actuator may extend at least partially into the punch path.

The fastener feed path may be defined at least in part by a surface of the body. This is advantageous in that the surface of the body limits the movement of fasteners in the elongate carrier relative to the apparatus and relative to the elongate carrier. This ensures that fasteners in the carrier are fed into the path of the punch in a reliable fashion. For example, the surface substantially prevents lifting or hooking of the fasteners by the punch during retraction, thus improving reliability of performance of the fastener insertion apparatus. The fastener feed path may extend through the body or may extend at one end.

In one embodiment, the at least one engagement member is reciprocally moveable between a retracted position in which it is disengaged from the carrier or fastener and an advanced position in which the carrier is advanced so as to bring a fastener into alignment with the end of the punch path. The movement of the engagement member back and forth between the retracted and advanced positions in response to the movement of the punch provides for reliable indexing of the fasteners in the carrier. It enables the carrier to be advanced along an arcuate feed path that has a sufficiently large radius to prevent kinking or unwanted bending of the carrier whilst allowing for a compact arrangement of the dispensing apparatus. In particular, a reciprocating engagement member can be arranged to occupy a much smaller spatial envelope in comparison to a rotating sprocket wheel. If the engagement member is arranged to engage the carrier rather than the fastener this has the advantage that it can be used with short fasteners that do not protrude significantly from the carrier. The idea of a reciprocating engagement member of this kind may be used independently of whether measures are taken to prevent lifting of the rivet or to support the punch during its passage through the body.

In operation the punch moves in a first direction along the punch path towards the workpiece. When it reaches the advanced position it extends into the fastener feed path so as to drive a fastener from the elongate carrier.

A nose may be provided for engagement with the workpiece. The nose may have a fastener delivery passage therethrough for delivery of a fastener to the workpiece after it has been removed from the elongate carrier and the fastener feed path by the punch. The fastener feed path may be defined at least in part by a clearance between the nose and the body. The nose is preferably fixed relative to the body. The nose may have an end surface for contact with the workpiece.

The actuator may be provided within the body so as to be engageable by the punch within the punch path, providing a compact solution to the problem of driving the feeding device.

The actuator may be engaged by a part of the punch in order to effect movement in the fastener feeding device. The engagement of the punch with the actuator may cause translational movement of the actuator substantially parallel to the punch path.

The actuator may be biased towards an initial position, to which it returns after engagement of the punch with the actuator ends. This return of the actuator means that the actuator need only be driven in one direction, which provides a simpler construction than one in which the actuator must be driven in both directions.

The bias may be provided by a resiliently compressible biasing member such as, for example, a spring. Translational movement of the actuator parallel to the punch path under engagement from the punch may cause compression of the biasing member.

The biasing member may be provided on substantially the opposite side of the punch path to the actuator.

Providing the biasing member separate from the actuator provides greater freedom in the design of the biasing member itself. It also allows a design of feeding mechanism in which the biasing member can be serviced and replaced without the need to remove or reposition the actuator, making the biasing member more easily accessible.

The punch may have a first portion at least a part of which extends from the punch path in the advanced position and a second portion, the actuator being moveable by the second portion of the punch. The actuator may be engageable by the second portion. The first portion may be a punch rod and the second portion may be a punch head or boss.

The actuator may be mechanically coupled to the at least one engagement member. The at least one engagement member may pivot about a pivot axis which intersects the body and/or which intersects the punch path. The at least one engagement member may have a first end that is coupled to the actuator and a second end for engagement with the carrier and/or the fastener. The pivot axis is preferably disposed between the first and second ends. The actuator may be biased by the biasing member, with the actuator being offset from the pivot axis on one side and the biasing member being offset from the pivot axis on an opposite side.

The body may have a bore that defines the punch path. The punch path or the bore may be defined by a support surface of the body and the punch may be supported along its length by the support surface as it reciprocates in the bore along the punch path. The support surface thus provides support to the punch throughout its insertion cycle such that in the event of a misfeed where the punch encounters a misaligned fastener and potentially damaging resistance forces are imparted to the punch the support surface prevents or restricts damage to the punch.

The punch path preferably defines a punch path axis along which the punch reciprocates and from which the punch extends to intersect the fastener feed path. The at least one engagement member is preferably moveable relative to punch axis.

The at least one engagement member may be external to the body or may be mounted within the body. The at least one engagement member comprises a first portion which extends alongside the body and a second portion which occupies the fastener feed path.

The at least one engagement member may engage the carrier or the fastener. In the case of the former the engagement member may comprise a main element and an engagement element moveable relative to the main element. The main element may be operated by the actuator and the engagement element may be moveably mounted on the main element. The engagement member may comprise a further biasing member, the further biasing member configured, in use, to bias the engagement element towards engagement with the carrier. The engagement element may be in the form of a tooth for engagement in an aperture or recess in the carrier.

The engagement element may be rotatably mounted on the main body. Such an arrangement is advantageous in that it allows more complex movement of the formation on the engagement member with respect to the carrier. The whole engagement member need not move in order to move the formation into (or out of) a driving position relative to the carrier.

The at least one engagement member may engage a fastener supported in the carrier. It may comprise an abutment surface such that, in use, the abutment surface abuts at least one of the fasteners supported in the elongate carrier so as to sequentially feed the fasteners into alignment with the end of the bore. The engagement member may have a tapered surface such that, in use, abutment of the tapered surface against at least one further fastener deflects the at least one engagement member around the fastener.

An advantage of engaging the carrier, rather than engaging a fastener in the carrier, is that the carrier can be reliably indexed through the apparatus even in the case when a fastener is missing from the carrier. Moreover, a wider variety of fasteners can be carried by the carrier since they do not need to be any particular shape in order to be indexed through the apparatus.

The body may comprise a guide bush for supporting the punch or it may be detachably connected to a guide bush that receives an upper part of the punch. The guide bush may be connectable to a driving actuator such as a hydraulic actuator.

A locking member may be provided that is engageable with the carrier such that, in use, the locking member prevents reverse movement of the carrier along the fastener feed path when a fastener is in the path of the punch. The locking member may be disposed in a downstream portion of the feed path.

The body may define an abutment surface in the fastener feed path, the abutment surface serving, in use, to prevent fasteners from being fed past the punch path and thus misaligned. The abutment surface may be an extension of the punch path.

The components of the fastener feeder device allow it to be packaged in a relatively slender unit in the direction of the tape. This allows the apparatus to be used in areas that have limited access. This is in contrast to existing insertion apparatus where the drive for the carrier tape is often disposed alongside the tape.

The fastener feed path may be defined by at least one carrier support for supporting the carrier in its movement along the feed path. A first carrier support may be defined on an opposite side of the fastener feed path to the body. The first carrier support may be defined upstream and/or downstream of the punch path. A second carrier support may be defined on the same side of the feed path and the punch path. At least part of the second carrier support may be defined by the fastener feed device and in particular by the at least one engagement member. At least part of the second carrier support may be defined upstream of the punch path. The at least one engagement member may be disposed so as to urge the elongate carrier into contact with the second carrier support. The second carrier support may define a recess to accommodate deflection of the carrier by the at least one engagement member.

According to a second aspect of the present invention there is provided fastener dispensing apparatus for dispensing fasteners into a workpiece, comprising: a body through which a punch path is defined; a punch at least partially within the punch path, the punch being reciprocally moveable between a retracted position and an advanced position in which the punch extends from an end of the punch path in order to drive a fastener towards a dispensing, the body defining a support surface that extends alongside the punch path and supports the punch during its movement along the punch path from the retracted to the advanced position; a fastener feed path extending transverse to the punch path, the fastener feed path being arranged for receipt of an elongate carrier of fasteners, the punch intersecting the fastener feed path in the advanced position; and a fastener feeding device for feeding the elongate carrier along the fastener feed path such that fasteners are sequentially brought into alignment with the end of the punch path, the fastener feeding device comprising an actuator moveable relative to the body by the reciprocal movement of the punch and at least one engagement member for engaging the elongate carrier or a fastener in the carrier, the at least one engagement member being moveable relative to the support surface.

The support surface may be defined by the part of the body that defines the punch path, which may be in the form of a bore. The body may also define a portion of the fastener feed path, more particularly an end of the body may define a surface that bounds the fastener feed path.

The apparatus in any of the aspects of the invention may be designed to insert a fastener into a workpiece after or at the same time as it is dispensed.

It will generally be appreciated that the features of the first aspect of the present invention as set out above may readily be taken in combination with the features of the second aspect of the present invention, either individually and in combinations.

According to a third aspect of the invention there is provided a method for dispensing a fastener comprising: providing an elongate carrier of fasteners in a fastener feed path; reciprocating a punch along a punch path in a body between a retracted position and an advanced position and into contact with a fastener disposed in the elongate carrier of fasteners, the fastener feed path extending transverse to the reciprocating direction of the punch, thereby driving a fastener out of the carrier towards a dispensed position; and using an actuator to feed the elongate carrier along the fastener feed path such that fasteners are sequentially brought into alignment with the end of the punch path; the reciprocal movement of the punch effecting movement of the actuator relative to the body; engaging the elongate carrier or at least one fastener in the elongate carrier with at least one engagement member and moving the at least one engagement member relative to the body in response to movement of the actuator; supporting a fastener adjacent to the punch path with a surface of the body, the surface defining at least part of the fastener feed path.

According to a fourth aspect of the present invention there is provided a method for dispensing a fastener comprising: providing an elongate carrier of fasteners in a fastener feed; reciprocating a punch along a punch path in a body between a retracted position and an advanced position and into contact with a fastener disposed in the elongate carrier of fasteners, the fastener feed path extending transverse to the reciprocating direction of the punch, thereby driving a fastener out of the carrier towards a dispensed position; supporting the punch with a support surface that extends alongside the punch path and supports the punch during its movement along the punch path from the retracted to the advanced position; using an actuator to feed the elongate carrier along the fastener feed path such that fasteners are sequentially brought into alignment with the end of the punch path; the reciprocal movement of the punch effecting movement of the actuator relative to the body; engaging the elongate carrier or at least one fastener in the elongate carrier with at least one engagement member and moving the at least one engagement member relative to the body in response to movement of the actuator.

In each of the method aspect of the invention the fastener may be inserted into a workpiece after or at the same time as being dispensed.

It will be appreciated that the inventive aspects outlined above may be applied to the dispensing, placing or insertion of components other than fasteners using the same feeding device.

BRIEF DESCRIPTION OF THE DRAWINGS

Specific embodiments of the invention are now described, by way of example only, with reference to the accompanying figures, in which.

DETAILED DESCRIPTION

Figure 1:
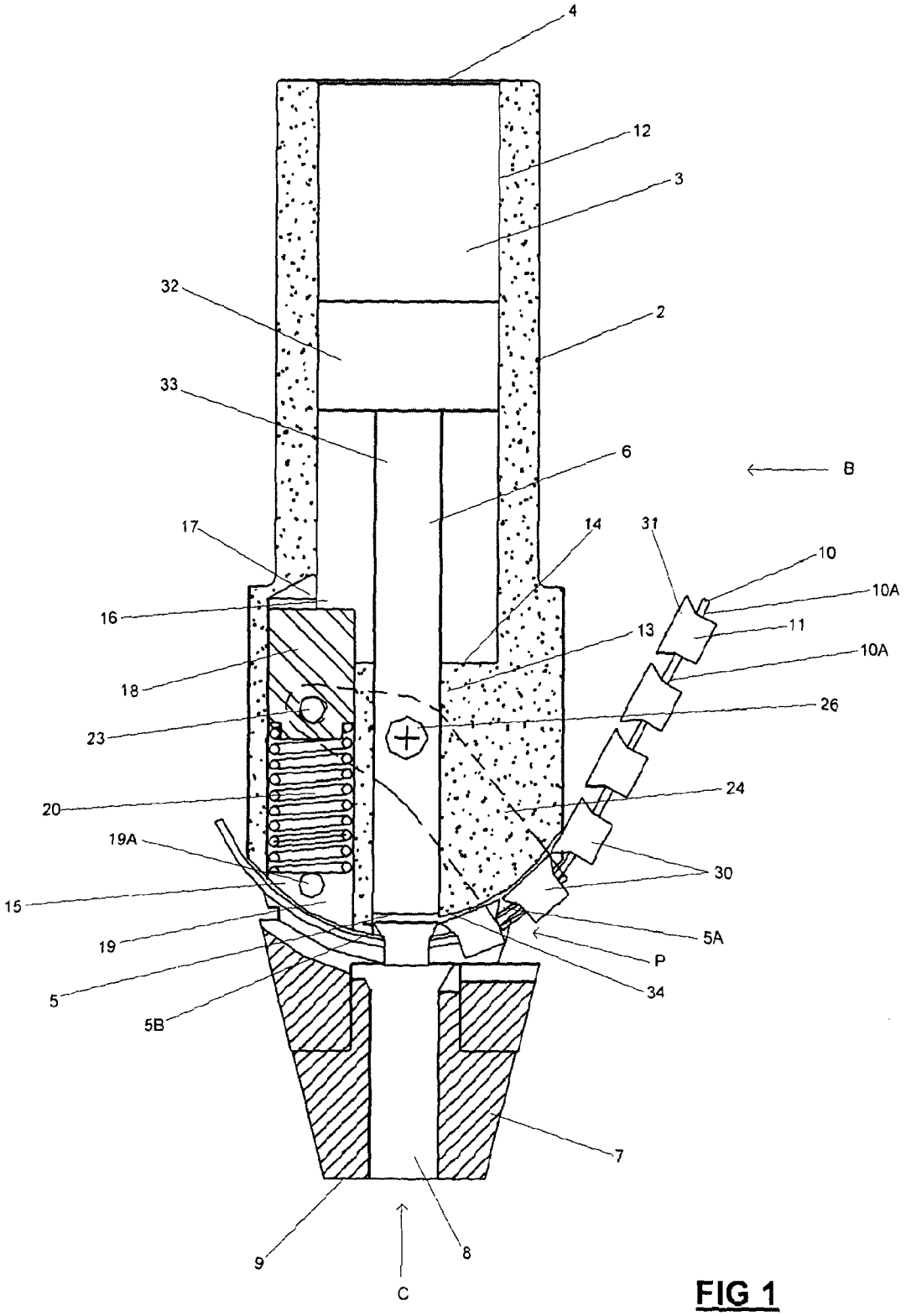
FIG. 1 is a cross-sectional side view (along line A-A of FIG. 4) of an embodiment of a fastener insertion apparatus in accordance with aspects of the present invention including a punch and shown loaded with a carrier tape of rivets.
Figure 2:
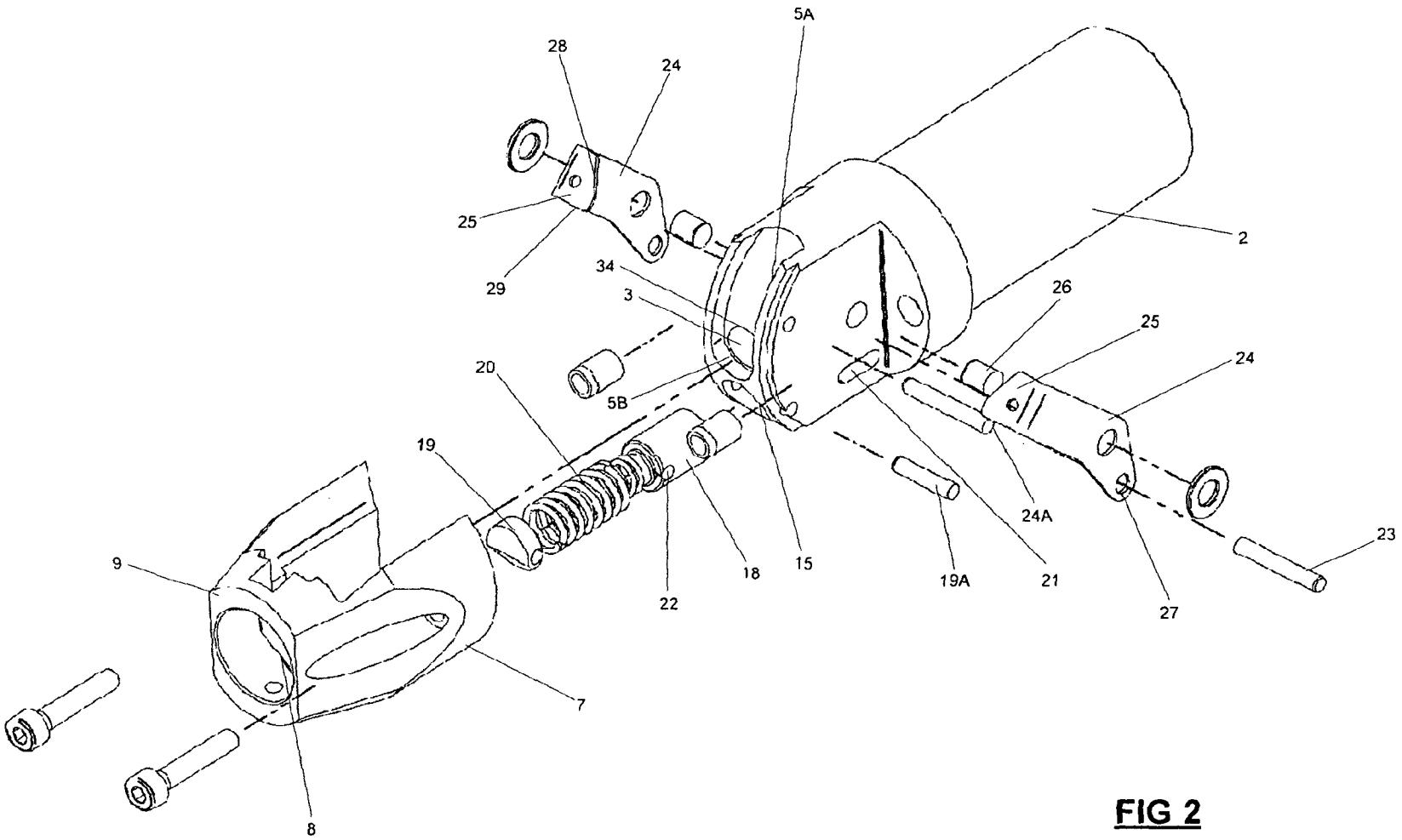
FIG. 2 is an exploded perspective view of the fastener insertion apparatus of FIG. 1, shown without the carrier tape of rivets.
Figure 3:
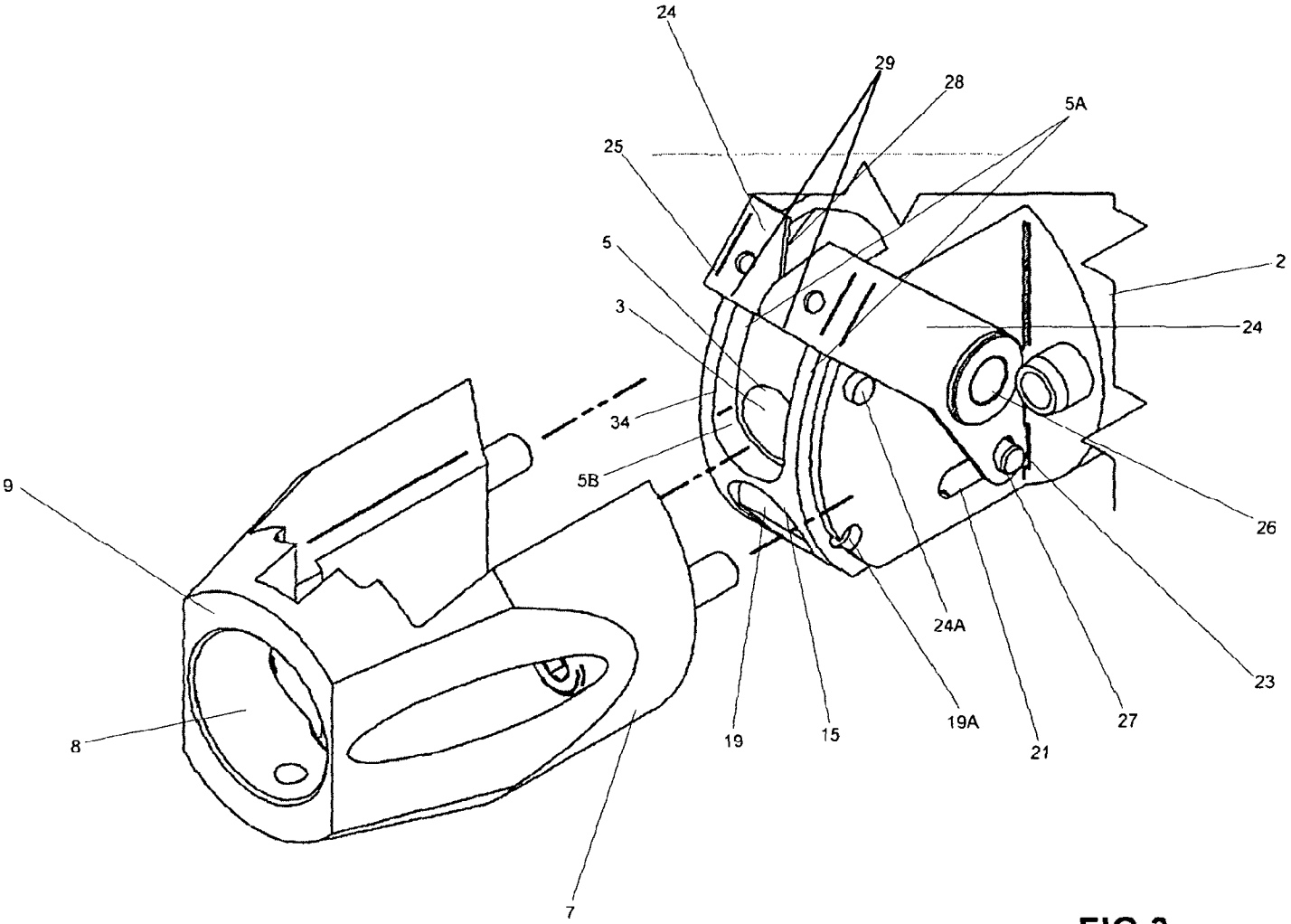
FIG. 3 is a partially assembled perspective view of part of the apparatus of FIG. 2.
Figure 4:
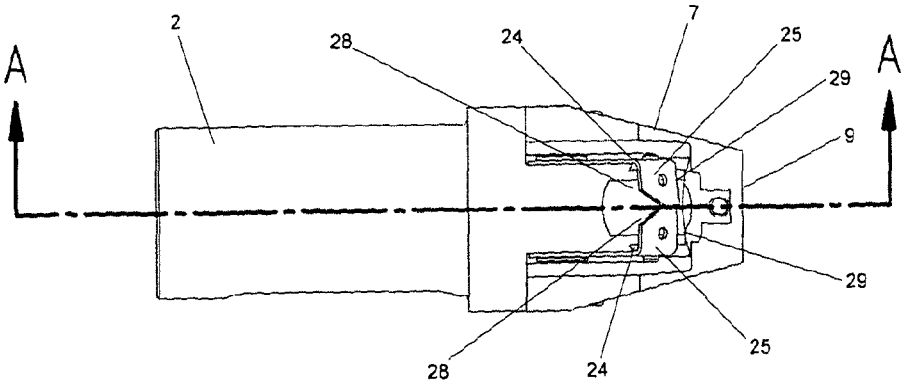
FIG. 4 is an orthogonal projection of the fastener insertion apparatus of FIG. 1 in the direction of arrow B, shown without the carrier tape of rivets.
Figure 5:
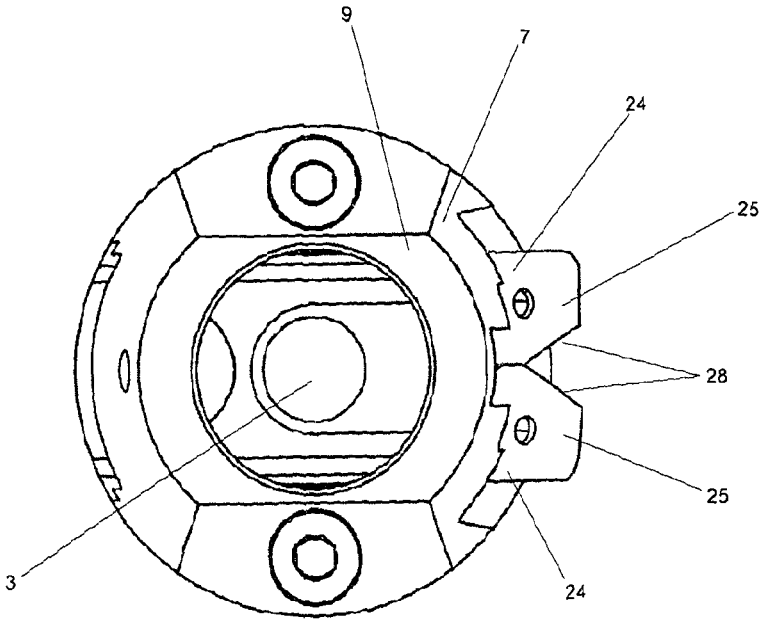
FIG. 5 is an end view of the fastener insertion apparatus of FIG. 1 in the direction of arrow C, shown without the carrier tape of rivets.

Referring now to FIGS. 1 to 5, a fastener insertion apparatus 1 comprises a generally cylindrical guide bush 2, which defines a bore 3 along its central longitudinal axis between upper 4 and lower 5 openings defined at opposite ends. A punch 6 travels reciprocally within the bore 3, the punch 6 being driven by a suitable actuator (not shown) that is connected to the guide bush 2 at the upper opening 4. It will be appreciated that the actuator may be any appropriate type including, for example, hydraulic, pneumatic or electrical. A lower end of the guide bush 2 has a pair of depending lateral walls 5A which define between them a channel that forms part of a path P for the passage of rivets into axial alignment with the bore 3, the walls 5A merging at one end of the channel to form an arcuate abutment surface 5B that closes the channel. The abutment surface 5B effectively provides a small extension to part of the surface that defines the bore 3.

A generally frustoconical nose 7 is provided beneath the lower end of the guide bush 2, the nose 7 being spaced from the guide bush 2 so as to provide a clearance between the nose 7 and the guide bush 2 for the feed path P. The nose 7 defines a longitudinal passage 8 in axial alignment with the bore 3 of the guide bush 2. At the lower end of the passage 8, the nose 7 defines a generally annular face 9 for contacting a workpiece (not shown) to be fastened.

In use, a tape 10 defining holes 10A for carrying rivets 11 is fed laterally along the path P beneath the guide bush 2 between the walls 5A by a fastener feeding mechanism that ensures that each rivet 11 in turn is axially aligned with the bore 3 and thereby the path of the punch 6 as will be described in more detail below.

The structure of the fastener insertion apparatus 1 is now described in greater detail. The bore 3 is divided into a wide diameter section 12 adjacent to the upper opening 4 and a narrow diameter section 13 adjacent to the lower opening 5. The guide bush 2 thus defines an internal annular shoulder 14 at the junction between the wide and narrow sections 12, 13 of the bore 3.

A cavity 15 running substantially parallel to the bore 3, extends between the lower end of the guide bush 2 and the wide diameter section 12 of the bore 3, merging at its upper end with the wide diameter section 12 at an internal aperture 16 which is partially defined by a portion of the shoulder 14 and partially defined by a portion of the wall of the wide section 12. The cavity 15 is sufficiently radially offset from the bore 3 that the wall of the wide diameter section 12 defines an abutment surface 17 within the cavity 15 adjacent to the internal aperture 16. A cylindrical actuator 18 is slidably disposed within the cavity 15. An end cap 19 (held by a pin 19A depicted in FIG. 2) blocks the lower end of the cavity 15, and a compressible spring 20 resides within the cavity 15 between the actuator 18 and the end cap 19 so as to bias the actuator 18 against the abutment surface 17. A portion of the actuator 18 therefore projects into the wide diameter section 12 of the bore 3 through the aperture 16. The actuator 18 is slidable within the cavity 14 against the bias of the spring 20 to a position in which the actuator 18 no longer projects into the wide diameter section 12 of the bore 3.

Two elongate slots 21 in the guide bush 2 extend along a portion of the length of the cavity 15, exposing the cavity 15 to the exterior of the guide bush 2. A hole 22 extends laterally through the actuator 18 so as to receive an actuating pin 23, the ends of which extend through the slots 21 to the exterior of the guide bush 2. Therefore, as the actuator 18 reciprocates within the cavity 15, the ends of the actuating pin 23 slide in the slots 21. Each end of the actuating pin 23 is mechanically engaged with a respective catcher 24 mounted on the exterior of the guide bush 2. The catchers 24, described in detail below, engage the rivets 10 so as to feed them into the path of the punch 8. The catchers 24 themselves are prevented from passing into the path of the punch by a guard pin 24A which projects from either side of the guide bush 2 adjacent to the lower end of the bore 3.

The two catchers 24 are in the form of generally longitudinally extending arms with laterally extending tips 25. The catchers 24 are mounted via pivot pins 26 on radially opposite sides of the exterior surface of the guide bush 2 such that the axis of rotation of the catchers 24 intersects the principal axis of the bore 3. The end of each catcher 24 remote from the laterally extending tips 25 is located adjacent to one of the elongate slots 21 and defines a slot 27 for mechanical engagement with an end of the actuating pin 23 protruding from the elongate slot 21. At the opposite end of each catcher 24, the laterally extending tip 25 extends across the lower end of the guide bush 2 such that the laterally extending tips 25 of the two catchers 24 meet one another in the path P between the guide bush 2 and the nose 7. The guard pin 24A extends through the guide bush 2 adjacent to the lower end such that its opposite ends protrude from the radial exterior surface of the guide bush 2. The catchers 24 rest against these opposite ends of the guard pin 24A so as to prevent the laterally extending tips 25 from moving into the path of the punch 6.

The fastener feeding mechanism thus comprises the actuator 18, spring 20, the actuating pins 23, the catchers 24 and the pivot pins 26. The actuator reciprocates within the cavity 15, carrying the actuating pin 23, which forces the catchers 24 to pivot about the pivot pins 26 such that the laterally extending tips 25 first sweep (in a first direction) away from the guard pin 24A before returning back (in an opposite second direction) to their original position against the guard pin 24A.

Each laterally extending tip 25 has a leading edge 28, which leads when the laterally extending tips 25 move in the first direction, and an opposite trailing edge 29. The leading edge 28 tapers so as to present an oblique angle to the first direction of movement of the tips 25. The catchers 24 are sufficiently flexible and resilient that they deflect outwardly from one another under stress so as to create a gap between the tips 25. When not under stress, the catchers 24 resiliently return to their original shape and the tips 25 once again meet between the guide bush 2 and the nose 7. It will be appreciated therefore that if the tapered leading edges 28 of the tips 25 abut an obstacle during movement in the first direction, the tips 25 (and thereby the catchers 24) will be deflected outwardly so as to pass the obstacle. However, if the trailing edges 29 of the tips 25 abut an obstacle during movement in the second direction, the lack of a taper on these edges 29 means that no such deflection will occur.

The holes 10A in the carrier tape 10 are evenly spaced along its length. Each rivet 11 comprises a shank 30, which is slightly larger than the holes 10A in the tape 10 so that the shank is a friction fit with the tape, and a head 31, which has greater cross-sectional dimensions than the holes 10A. Thus, each rivet 11 sits in the tape 10 such that the shank 30 passes through a hole 10A in the tape and the rivet head 31 abuts the tape to prevent the rivet 11 falling out of the tape 10.

In use, as shown in FIG. 1, the tape 10 is fed through the fastener insertion apparatus 1 by the feeding mechanism so as to pass along the path P between the lower end of the guide bush 2 and the nose 7. The head 31 of each rivet passes through the channel portion of the path P defined between the walls 5A. The catchers 24 are disposed on each side of the tape 10 such that the tips 25 occupy the path P and pass under the tape 10. However, the dimensions of the rivets 11 in the tape 10 are such that the tips 25 cannot pass under the shanks 30 of the rivets 11. Rather, the tips 25 extend between successive rivet shanks 30 and may only travel past a rivet 11 when the tips 25 are deflected outwardly by the shanks 30 as described above. Therefore, the rivets 11 may pass the tips 25 in one direction, by abutting the tapered leading edge 28 and deflecting the catchers 24 outwardly, but not the other. This provides a convenient indexing function between the catchers 24 and the tape 10 of rivets 11.

The punch 6 comprises a piston head 32, which is drivable through the upper opening 4 of the guide bush 2 by an appropriate driving actuator, and punch rod 33, which extends from the piston head 32. The arrangement is such that during reciprocation of the punch (in a rivet insertion cycle) the lower end of the punch rod 33 emerges from the lower opening 5 in the guide bush 2 so as to engage a rivet 11 and insert it into a workpiece. The diameter of the piston head 32 corresponds closely to that of the wide section 12 of the bore 3 and the diameter of the punch rod 33 corresponds closely to that of the narrow section 13. Accordingly, the piston head 32 is guided and supported by the wide section 12 of the guide bush 2, and while the punch rod 33 is travelling within the narrow section 13, it is also guided and supported by the guide bush 2. The extent of possible translation of the punch 6 within the bore 3 is restricted in that the piston head 32 cannot move into the narrow section 13 of the bore 3. It will be apparent that as the punch 6 is advanced within the bore 3, the piston head 32 abuts the actuator 18 forcing it to slide against the spring 20 further into the cavity 15.

Figure 6E:
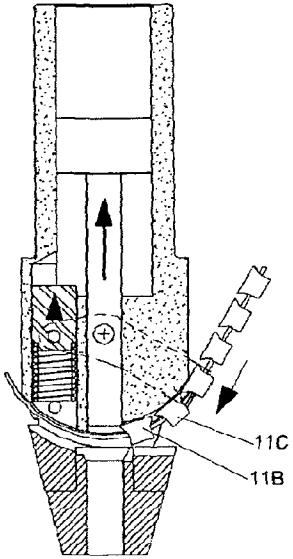
FIGS. 6A to 6E show cross-sectional side views of the fastener insertion apparatus of FIG. 1 including the punch and shown loaded with a carrier tape of rivets, the views showing a chronological sequence of the feeding process during a single fastener insertion cycle.
Figure 6D:
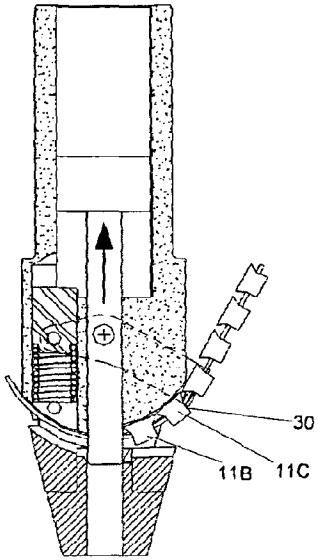
Figure 6C:
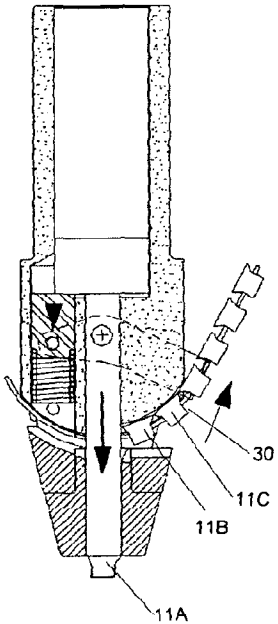
Figure 6B:
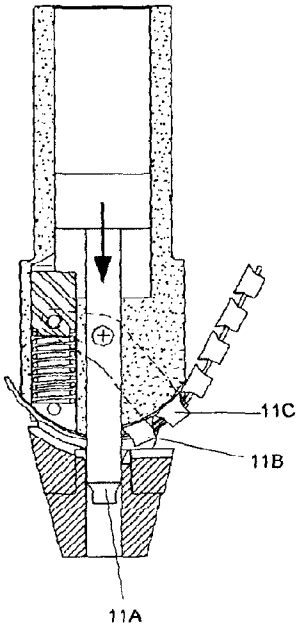
Figure 6A:
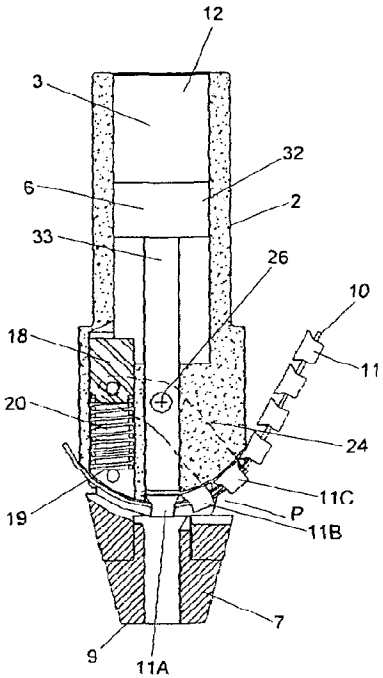

In operation, as shown in FIG. 6A, a rivet 11A is disposed at the end of the bore 3 in the path of the punch 6. The punch rod 33 advances in the bore 3 and emerges from the lower opening 5 into path P. The punch rod 33 passes through the tape 10, driving the rivet 11A out of the hole 10A in the tape 10 and through the passage 8 in the nose 7, as shown in FIG. 6B. As the punch rod 33 drives the rivet 11A out of the end of the passage 8 and into a workpiece (not shown but against which the annular face 9 of the nose 7 has been positioned), as shown in FIG. 6C, the piston head 32 engages the actuator 18 and forces it further into the cavity 15. This causes the catchers 24 to pivot about the pivot pins 26, sweeping the laterally extending tips 25 of the catchers 24 away from the bore 3 in the first direction as described above. The tape 10 is held fast by the engagement of the punch rod 33 through the hole 10A in the tape 10. The tapered leading edges 28 of the tips 25 therefore abut the next-but-one rivet 11C in the tape 11, causing the catchers 24 to be deflected outwardly as described above. Once past the next-but-one rivet 11C, the catchers 24 resiliently return to their original shape, snapping back behind the next-but-one rivet 11C such that the trailing edges 29 abut the shank 30 of the rivet 11C. After insertion of the rivet 11A into the workpiece, as shown in FIG. 6D, the punch 6 retracts and the piston head 32 releases the actuator 18. The tape 10 initially remains held in place by virtue of the punch rod 33 occupying the hole 10A in the carrier tape 10. In this position, the laterally extending tips 25 cannot pass the next-but-one rivet in a return direction, as described above. The catchers 24 are therefore held away from the bore 3 by the rivet 11C in the tape 10. The catchers 24 in turn hold the actuator 18 in place within the cavity 15 against the resilience of the spring 20. As indicated in FIG. 6E, the punch rod 33 subsequently retracts sufficiently to release the tape 10, so that the catchers 24 can pivot back to their original position under the influence of the spring 19 and the actuator 18 which moves back to a position in which it protrudes into the wide section 12 of the bore 3. The laterally extending tips 25 of the catchers 24 thereby sweep back (in the second direction described above) to their original position pushing the next-but-one rivet 11C and feeding the tape 10 past the bore 3 until the next rivet 11B contacts the abutment surface 5B and is aligned with the bore 3 in the path of the punch 6.

The feeding mechanism is advantageous in that the reciprocation of the punch 6 during each rivet insertion cycle causes the next rivet 11 to be fed into the path of the punch 6. This is a simple and elegant solution to the problems of powering and timing the feeding of the rivets 11 into the path of the punch 6. The catchers 24, actuator 18, guard pin 24A and tape 10 are configured such that when the catchers sweep back to their original position the next rivet 11B is correctly aligned with the path of the punch 6. It will, however, be appreciated that in the event that the relationship between these components is altered, for example if there is a defect in the tape 10, the abutment surface 5B prevents overfeeding of the rivet 11B past the bore 3, maintaining the rivet 11B in the path of the punch 6.

The provision of catchers 24 that move around the guide bush 2 ensures that the punch 6 can be supported during its advance. In particular, the guide bush 2 provides a bore 3 that extends close to the point at which rivets 11 are driven out of the tape 10. This is advantageous in that the punch 6 is less likely to be damaged in use if it is supported as it extends. Furthermore, rivets 11 which are being fed into the path of the punch 6 are close to the lower end of the guide bush 2, which more tightly controls the movement of the rivets 11 than if the tape 10 was moving through an open space.

Two examples illustrating the advantages of this embodiment of the present invention are described below with reference to FIGS. 7 and 8.

In operation, two malfunctions that can occur in rivet insertion apparatus are partial feeding, in which a rivet is not fully aligned with the path of the punch, and rivet "lifting", in which the return motion of the punch causes the punch to "lift" the next rivet dislodging it from its seated position in the tape.

Figure 7:
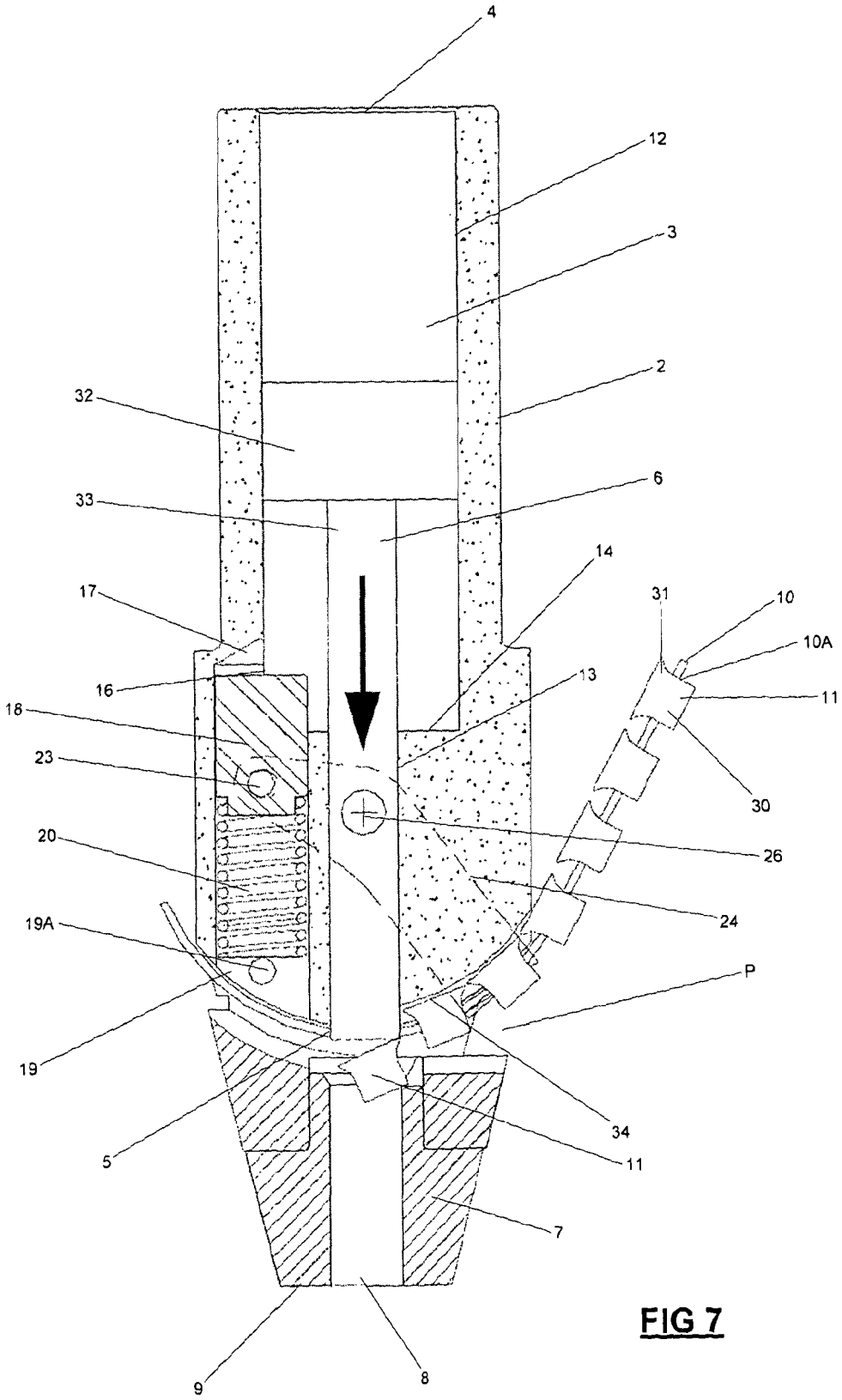
FIG. 7 shows a cross-sectional side view of the fastener insertion apparatus of FIGS. 6A to 6E but depicting a rivet jam.

FIG. 7 illustrates what happens when a misaligned rivet 11 is driven by the punch 6. Upon contact of the punch 6 with the rivet 11, the rivet 11 is forced against the nose 7 at the upper edge of the passage 8 such that it jams. The force applied by the punch 8 against the jammed rivet 11 induces shear stresses in the punch rod 33. The guidance and support provided by the guide bush along the length of the punch reduces the likelihood that the shear stresses on the punch rod 33 will result in the punch rod 33 bending or breaking under those stresses. Instead, the rivet 11 will simply be sheared by the punch 6.

Figure 8:
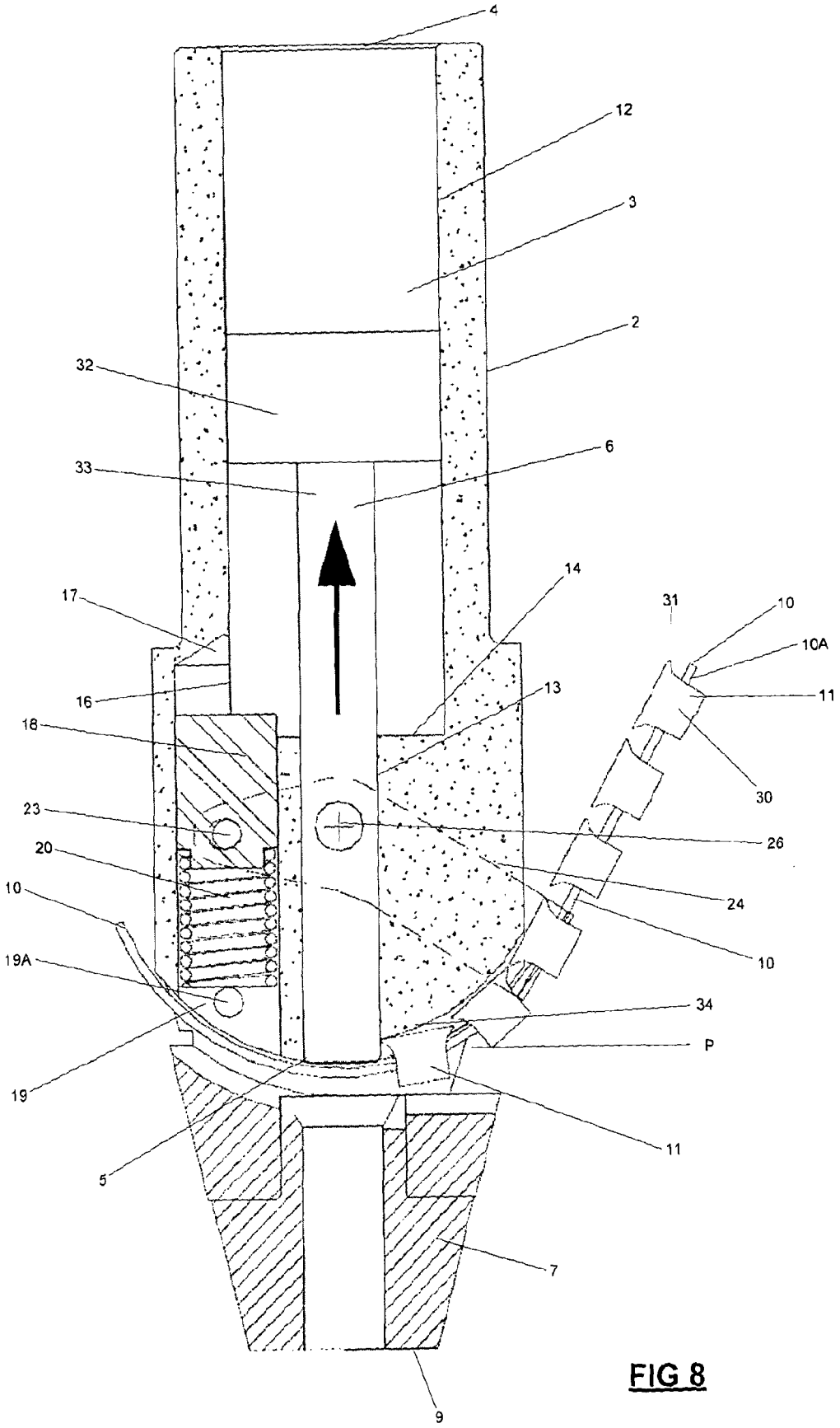
FIG. 8 shows a cross-sectional side view of the fastener insertion apparatus of FIGS. 6A to 6E but depicting a rivet being lifted during retraction of the punch.

FIG. 8 shows a rivet 11 being lifted by the punch rod 33 during retraction of the punch 6. The guide bush 2 provides a bore 3 that extends close to the point at which rivets 11 are driven out of the tape 10, which means that a surface 34 of the guide bush 2 around the lower opening 5 defines a portion of the path P of the tape 10. Thus when the punch 6 lifts the rivet 11, the rivet 11 abuts the surface 34 at the bottom of the channel between walls 5B adjacent to the lower opening 5 before it has moved sufficiently to be dislodged from its seated position within the tape 10. This prevents the rivet 11 from being dislodged from the tape 10 and reduces jams and misaligned rivets.

Further embodiments of fastener insertion apparatus which engage with the tape rather than the rivets so as to move the tape through the apparatus are now described with reference to FIGS. 9 to 20. Features of each further embodiment which correspond to features of the first embodiment have had their reference numbers increased in increments of 100. Features of the embodiments will only be described so as to highlight differences from previous embodiments of the invention.

Figure 9:
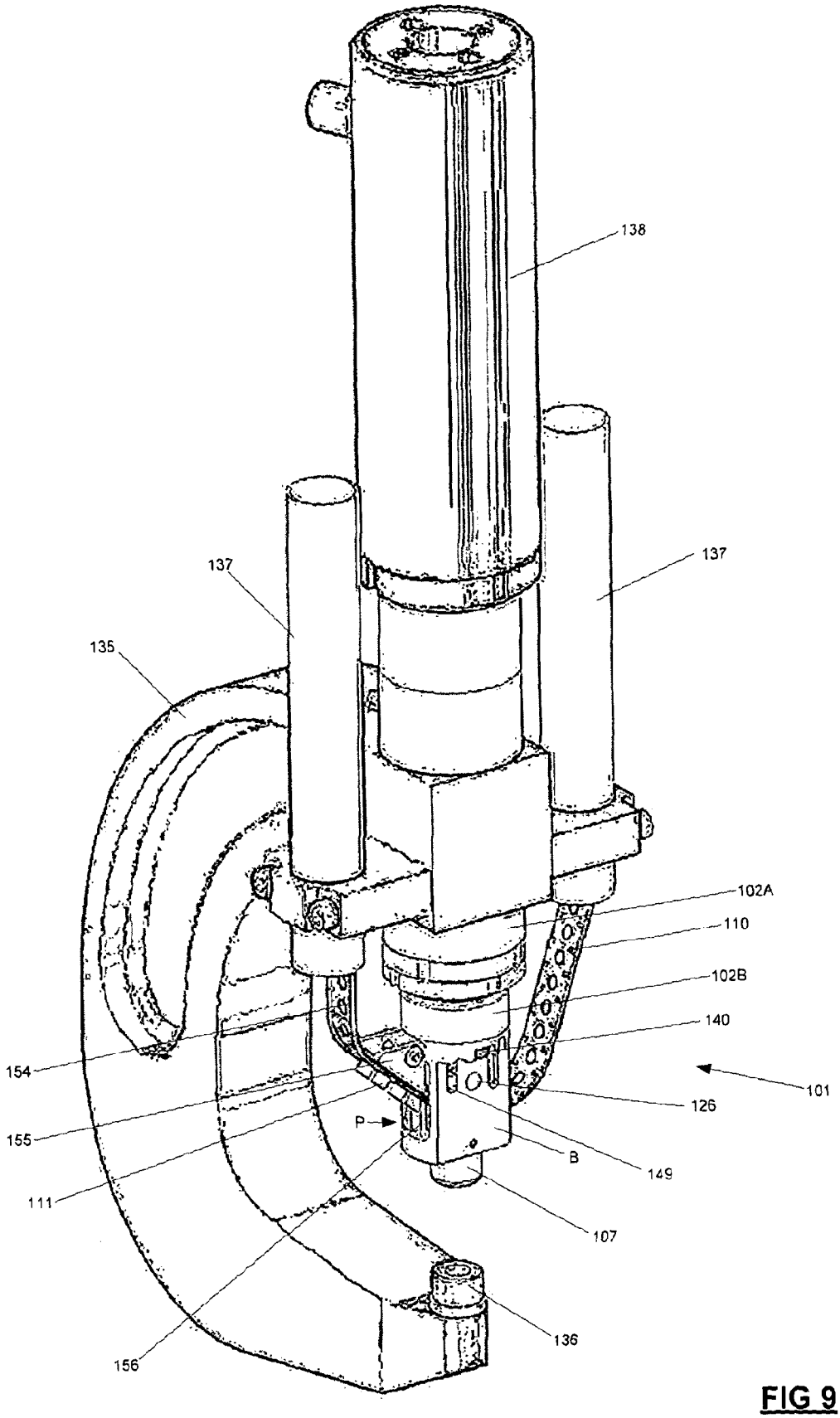
FIG. 9 is a perspective view of a second embodiment of a fastener insertion apparatus in accordance with the present invention, mounted on a C-frame and loaded with a tape of rivets.
Figure 10:
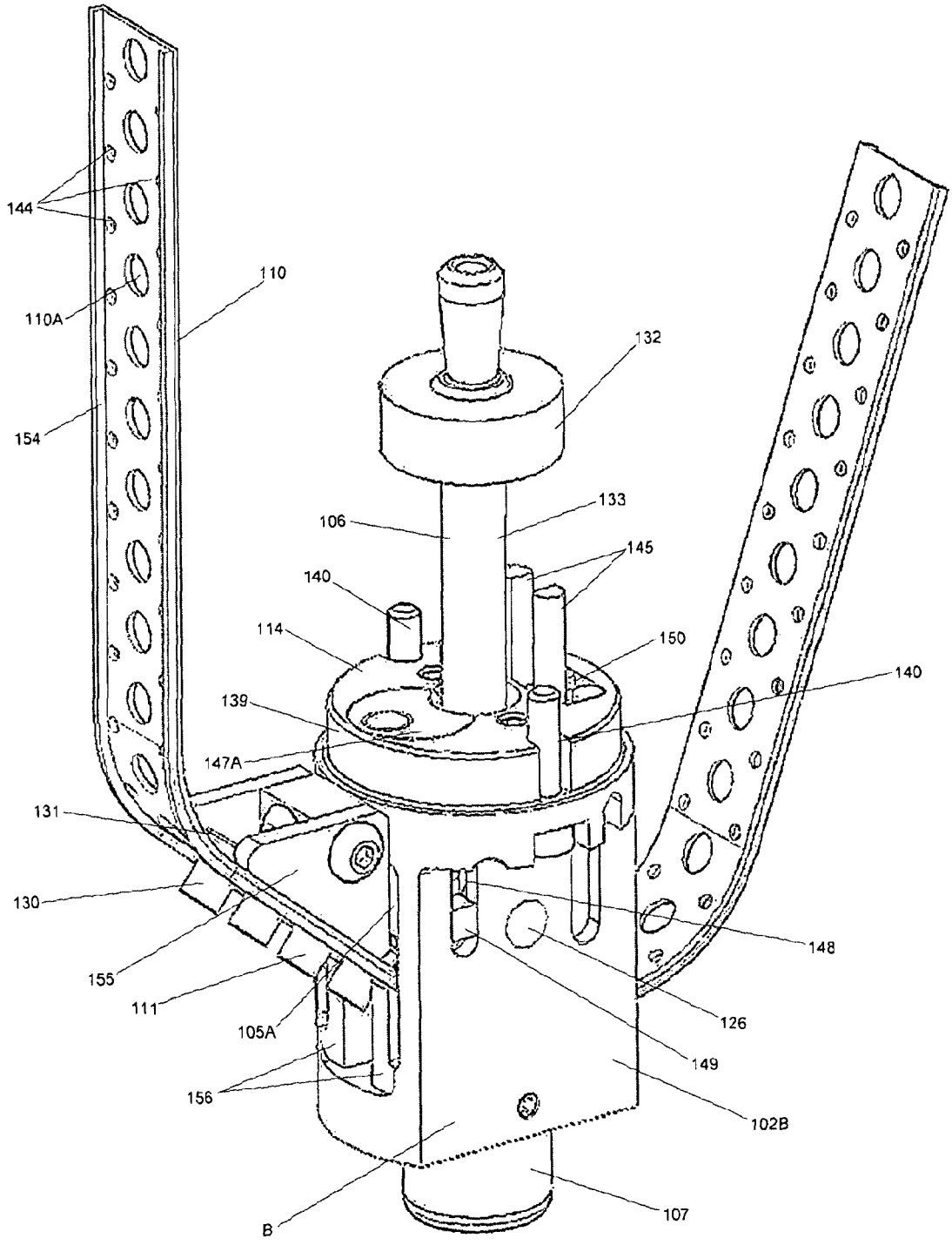
FIG. 10 is a perspective view of a lower part of the fastener insertion apparatus of FIG. 9.
Figure 11:
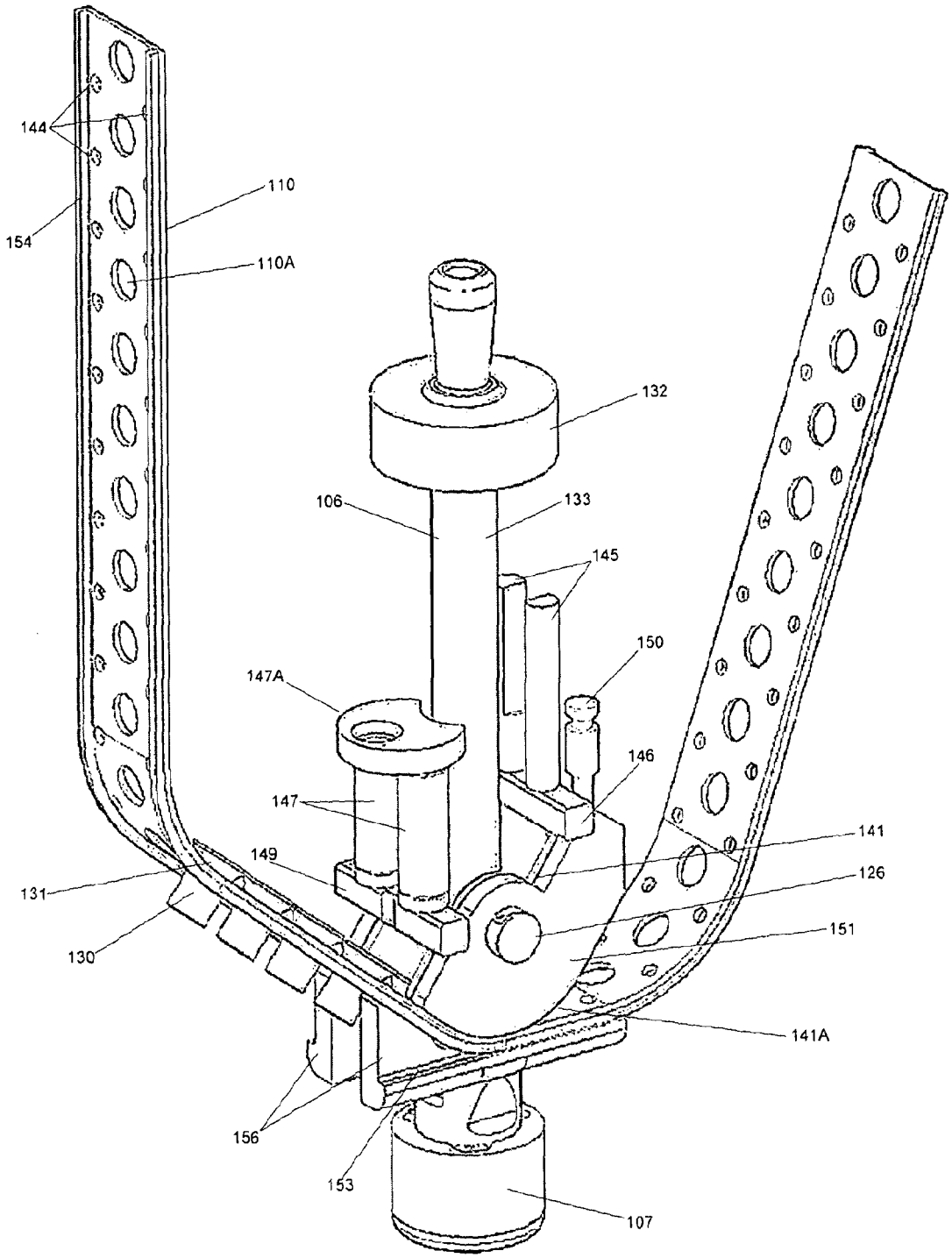
FIG. 11 shows the same part of the fastener insertion apparatus shown in FIG. 10 but a body of the fastener feeding device removed for clarity.
Figure 12:
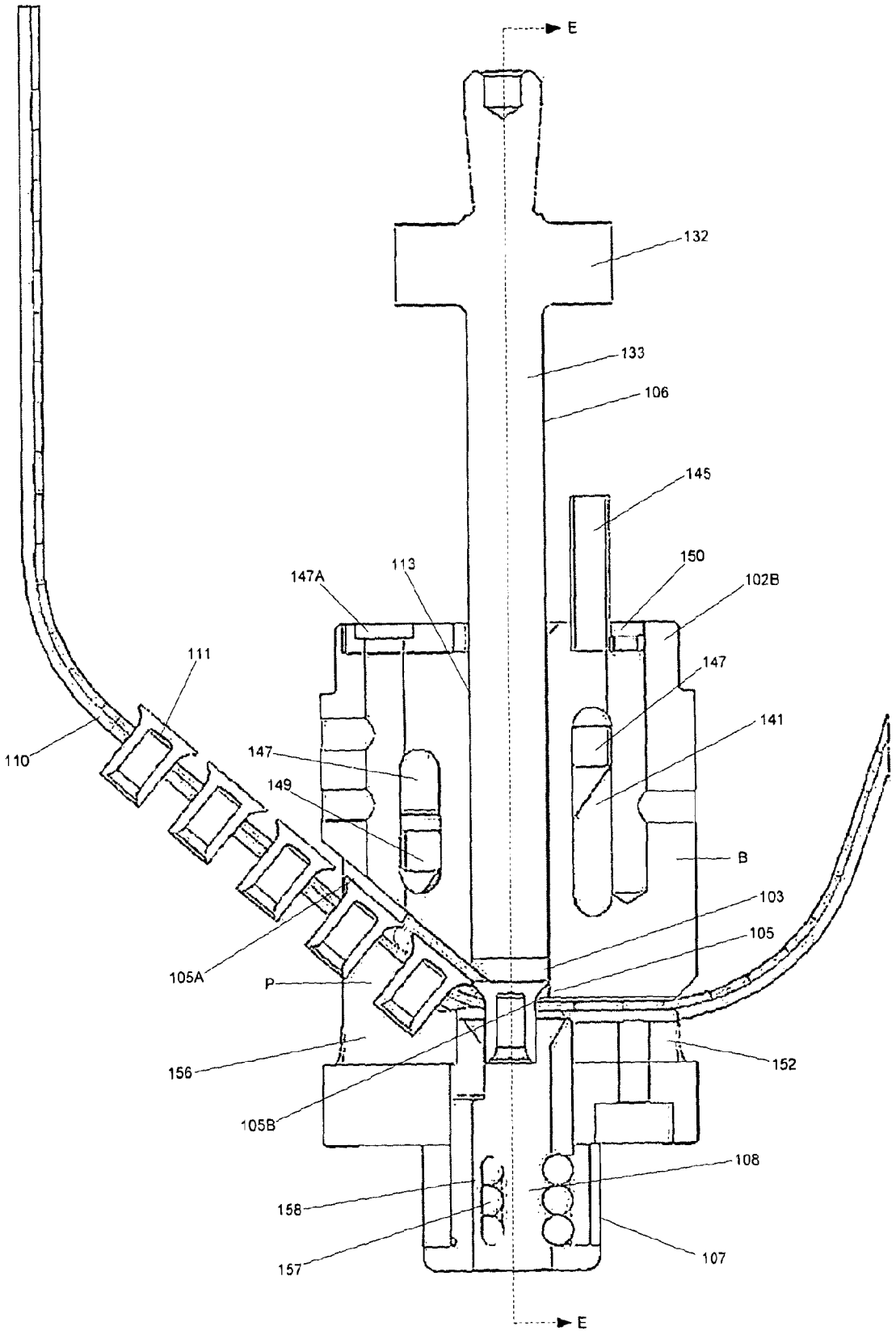
FIG. 12 is a side cross section of the part of the fastener insertion apparatus shown in FIG. 10, along line D-D of FIG. 13.
Figure 13:
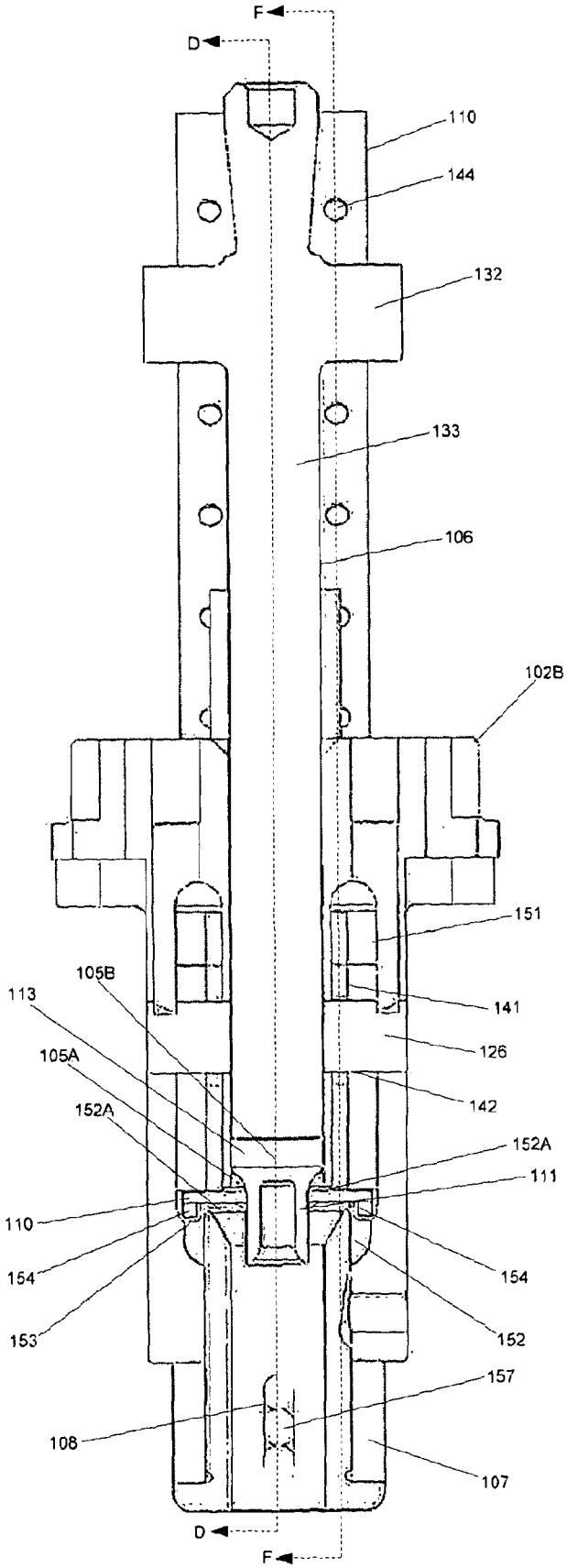
FIG. 13 is a side cross section of the part of the fastener insertion apparatus of FIG. 10, along line E-E of FIG. 12.

FIG. 9 shows a fastener insertion apparatus 101 in an assembled state and mounted on the upper arm of a C-frame 135 opposite the lower arm of the frame 135. The lower arm of the frame 135 supports a die 136 over which a workpiece is placed. The apparatus comprises a hydraulic cylinder actuator 138. In operation, the actuator drives nose 107 of the apparatus in descent towards the die until it comes into contact with the workpiece and may clamp the workpiece with any appropriate clamping force profile. The actuator 138 then drives the punch (hidden in FIG. 9) such that it performs a rivet insertion cycle to insert a rivet 111 into the workpiece.

The fastener insertion apparatus 101 comprises a longitudinal guide bush 102A, beneath which is provided a fastener feed assembly 102B comprising a body B that supports a number of feed assembly components. The nose 107 is mounted beneath the fastener feed assembly 102B and defines a passage 108 (see FIG. 12) which is axially aligned with a bore 103 in the feed assembly body B. Referring now to FIGS. 9 to 16, a fastener feed path P is defined through the feed assembly 102B below an inclined bottom edge of internal side wall 105A of the body B and an internal arcuate abutment surface 105B is defined below the bore 103 as in the previous embodiment. In this particular embodiment the rivets are fed into the fastener feed assembly 102B rather than between the guide bush 2 and the nose piece 7, as in the first embodiment. It will be noted that the body B is relatively slender and only slightly wider than the carrier tape itself. This enables the insertion apparatus to be used in confined areas where access is limited.

In use, a carrier tape 110 of rivets 111 (other fasteners may be used) is fed along the feed path P. Two substantially vertical tubes 137 (shown only in FIG. 9) are mounted on the upper arm of the support 135, one on each side of the fastener insertion apparatus 101, so as to receive opposite ends of the tape 110. Thus, in operation, carrier tape 110 with rivets present 111 is drawn through one of the tubes 137 to the apparatus 101, where it passes laterally along the fastener feed path P. Used tape 110, from which the rivets have been punched, leaves the fastener feed path P on the other side of the fastener insertion apparatus 101 and passes into the other tube 137.

Whereas in the first embodiment of the invention the fastener feed mechanism 18, 20, 23, 24, 26 is arranged in and around the guide bush 2, in this second embodiment there is provided a separate feed assembly 102B that is disposed below the guide bush 102A. An advantage of providing the guide bush and feed assembly as separable components is that servicing and maintenance of the feed assembly may be performed more easily. Moreover, different size feed assemblies may be connected to the guide bush 102A. It will be appreciated that in many respects the fastener feed assembly 102B functions in the same way as the fastener feed mechanism of the first embodiment.

In particular, it will be appreciated that both the guide bush 102A and the feed assembly 102B support and guide the punch 106 as it reciprocates during rivet insertion. The punch 106 reciprocates within a bore 103 defined partly by the guide bush 102A and partly by the feed assembly 102B. The guide bush 102A defines a wide section (not shown) of the bore 103 and the fastener feed assembly 102B defines a narrower section of the bore, analogous to the upper and lower sections 12, 13 of the bore 3 of the first embodiment. The guide bush 102A is only shown in FIG. 9.

Referring to FIGS. 10 to 16, the punch 106 comprises a piston head 132 and a punch rod 133, as in the first embodiment. The piston head 132 and punch rod 133 have diameters which respectively correspond to the diameters of the wide section and the narrow section 113 of the bore 103. Thus, only the punch rod 133 may enter the narrow section 113 of the bore 103 because the piston head 132 is too wide. The rod 133 is thus supported throughout its descent by the part of the body B that defines the narrow section 113 of the bore 103. The guide bush 102A is essentially a tubular member which acts as a piston cylinder within which the piston head 132 moves.

The fastener feed assembly body B houses a feed mechanism which is engaged by the punch 106 so as to feed rivets 111 into the path P. The body B has a cylindrical upper end defining an annular upper surface 114, having at its centre the upper opening of the narrow section 113 of the bore 103. At the exterior edge of the annular surface 114, a circumferential exterior rim 139 is defined for engagement with the guide bush 102A. A pair of screws 140 which project upwardly out of opposite sides of the annular surface 114 are used to secure the guide bush 102A to the feed assembly 102B.

A pair of indexing arms 141 is rotatably mounted to the body B on pivot pins 126 that are received in respective apertures 142 defined in the arms 141. The indexing arms 141 are mounted in a similar way to the catchers 24 of the first embodiment and move in a similar way, so as to perform a similar function. In contrast with the catchers 24, however, the indexing arms 141 are mounted inside the body B of the feeder assembly 102B. Each indexing arm 141 comprises a curved edge 141A which, in use, is adjacent to an upper edge of the tape 110. Each curved edge 141A defines a single tooth 143 having an oblique upstream edge (with respect to the feed path P) and an upright downstream edge. Each tooth 143 is configured to engage a corresponding series of regularly spaced indexing holes 144 defined towards the edge of the tape 110. When one of the teeth 143 is in an indexing hole 144, the upright edge of the tooth 143 is engageable with the edge of the indexing hole 144 such that rotation of the indexing arm 141 so as to move the tooth 143 in a downstream direction drives the tape 110 downstream with the tooth 143. When the indexing arms 141 rotate so as to move the teeth 143 in an upstream direction, however, the oblique upstream edge of the tooth 143 bears against the edge of the indexing hole 144 and lifts the tooth 143 out of the hole 144, allowing the tooth 143 to slide along an upper surface of the tape 110 to the next hole 144. Subsequent downstream movement of the tooth 143 (as described above) then causes the tooth 143 to engage with the edge of this next hole 144 and drive the tape 110 in the downstream direction. In this way the indexing arms 141 may be rotated back and forth so as to reliably index the tape 110 through the apparatus 101. The mechanism by which the indexing arms 141 are actuated is now described.

A pair of elongate actuators 145 are slidably mounted side by side above the fastener feed path P. The actuators 145 are connected together at their lower ends by a transverse first load spreading bar 146. In a retracted position the upper ends of the actuators 145 extend above the annular surface 114 towards the piston head 132. The first load spreading bar 146 abuts downstream portions of the indexing arms 141 such that, when the actuators 145 are pushed downwards to an extended position, the first load spreading bar 146 forces the indexing arms 141 to rotate about pins 126 such that the teeth 143 move in an upstream direction. A pair of compression springs 147 is provided within a cavity 148 on the upstream side of the feed assembly 102B. The compression springs 147 are retained within the cavity 148 by a spring retainer 147A fixed in the upper surface of the fastener feed assembly 102B. The compression springs 147 are joined together at their lower ends by a second load spreading bar 149 parallel to the first load spreading bar 147, and which engages upstream portions of the indexing arms 141 when the arms 141 rotate in an upstream direction. Thus, downward movement of the actuators 145 rotates the indexing arms 141 so as to compress the compression springs 147 between the indexing arms 141 and the end cap 147A. When the indexing arms 141 are no longer being held against the resilience of the compression springs 147, the springs 147 bias the indexing arms 141 back towards their initial position so that the actuators 145 are pushed back up to their retracted position. The end cap 147A serves for easy access to the compression springs 147 for servicing and replacement. The actuators 145 are extended and retracted as the punch descends and retracts during a rivet insertion cycle, and this rotates the indexing arms 141 as described above, thus indexing the tape 110 through the apparatus 101. Adjacent to the actuators 145 on the downstream side of the guide bush 102, a static stop member 150 is provided in the rotational path of the indexing arms 141 so as to prevent over-rotation of the indexing arms 141 past their initial position upon their return (forward) movement.

So as to improve the reliability with which the punch 106 drives rivets 111 from the tape 110, rotatable tape retainers 151 flank the arms 141 and are supported on the same pivot pins 126 so as to rotate with the indexing arms 141. The tape retainers 151 have substantially the same profile as the indexing arms 141, having edges adjacent the edges 141A which run along edge portions of the upper surface of the tape 110, but do not define teeth for engagement with the tape 110. A pair of walls 156 flank the rivet path P on each side and are disposed below the retainers 151 with a small clearance for receipt of the carrier tape 110. The upper surface of the walls 156 serve to guide the underside of the tape along the path P whilst the tape retainers hold the tape against walls 156. A lower portion of each wall has a shoulder 153 that serves to support the tape under the retainers 151 and on the downstream side, the tape having ridges 154 at its edges which run against a top edge of the wall 156 so as to maintain the tape in alignment in the fastener feed path P.

On the upstream side in order to ensure that the tape 110 is fed into the apparatus 101 at an appropriate angle, the upper surface of the walls 156 are inclined at an appropriate angle. The upper surfaces of the walls 156 each define a recess 156A (best seen in FIGS. 14 and 15) so as to allow deflection of the tape 110 from its path P upstream of the passage 108 and bore 103. This allows the tooth 143 of each indexing arm 141 to deflect the tape 110 into the recess 156A as the indexing arm 141 rotates, allowing the tooth 143 to slide upstream over an upper surface of the tape 110 from one indexing hole 144 to another. Further upstream above the tape a pair of spaced triangular plates 155 may be disposed such that the longest edge of each plate is in contact with a portion of the edge of the tape 110. The walls 156 are disposed with the body B of the feed assembly 102B.

It will be appreciated that several modifications may be made to the walls 156 so as to improve the reliability of support and/or ease of construction, including the addition of a biasing member (e.g. a resilient pad) within the recess 156A, which biases the tape 110 towards the indexing arm 141. Alternatively, the recess 156A may be omitted and the upstream portion of the wall 156 configured to be moveable relative to the body B in a lateral direction away from the punch axis, such that force applied by the indexing arms 141 and tooth 143 on the carrier tape 110 moves the wall 156 in the lateral direction.

Figure 14:
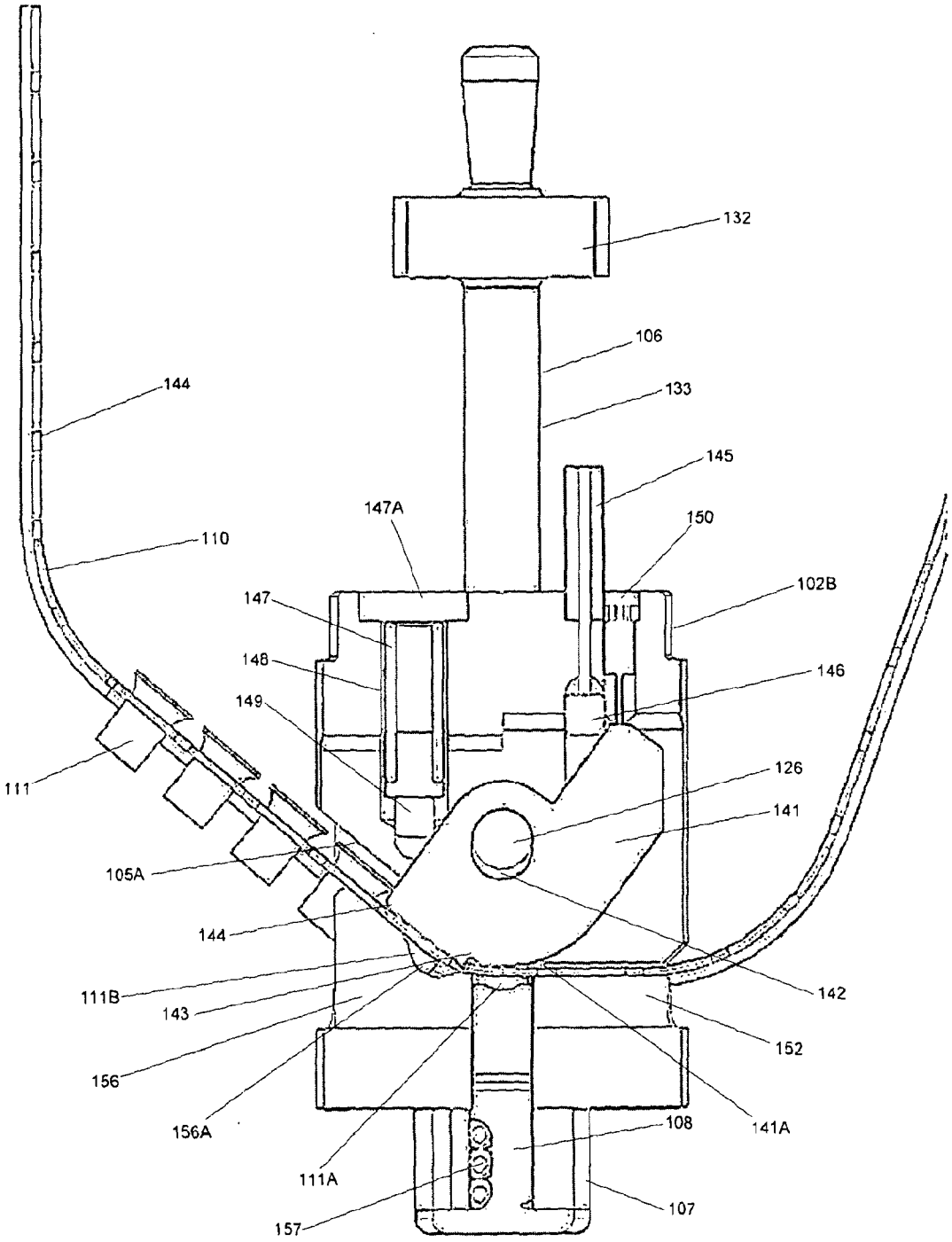
FIG. 14 is a part-sectioned side view of the part of the fastener insertion apparatus of FIG. 10, along line F-F of FIG. 13 and with a fastener feeding device being in a first position.
Figure 15:
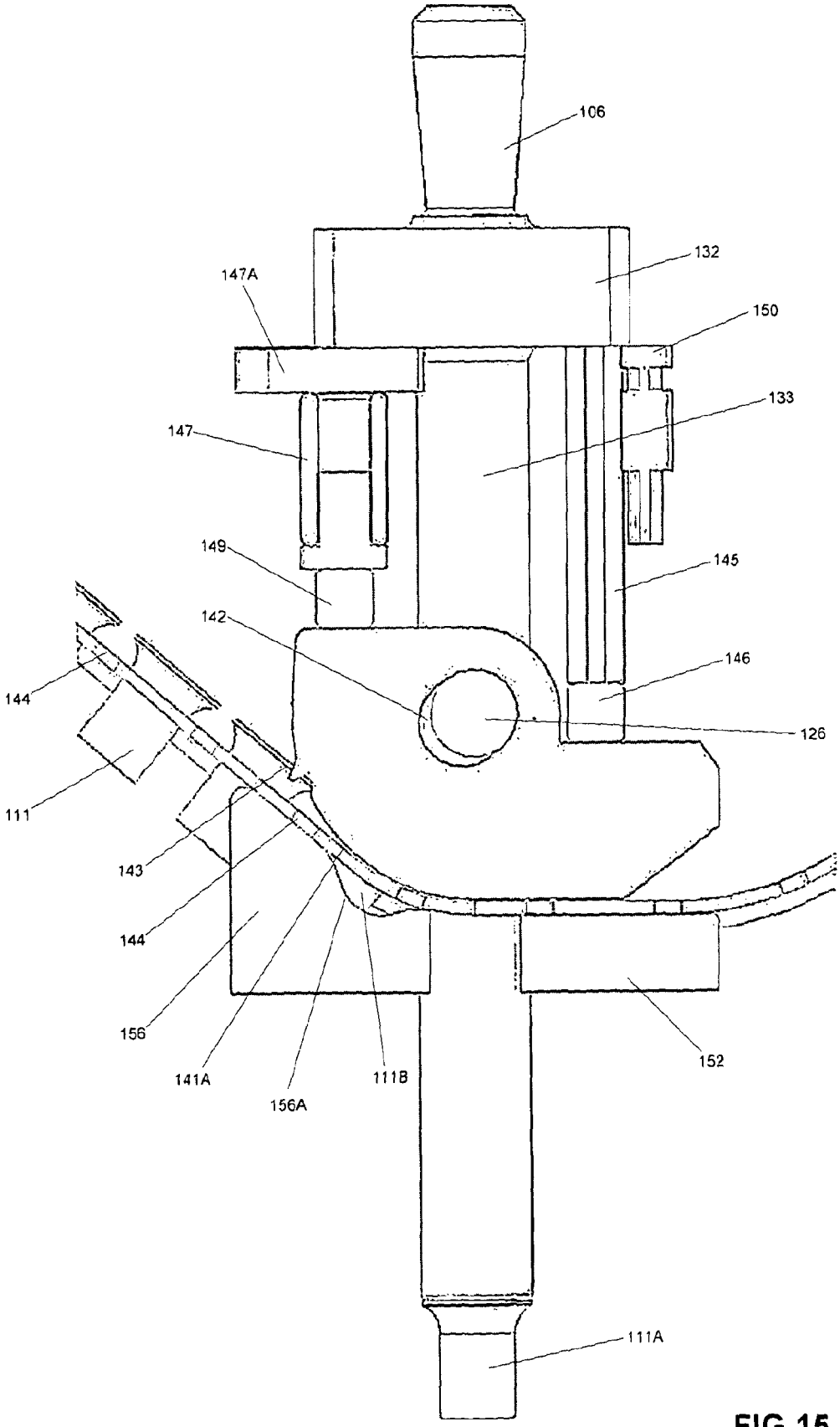
FIG. 15 is a part-sectioned side view of the part of the fastener insertion apparatus shown in FIG. 14, the feeding device being in a rotated position and the body having been removed to expose the feeding device.
Figure 16:
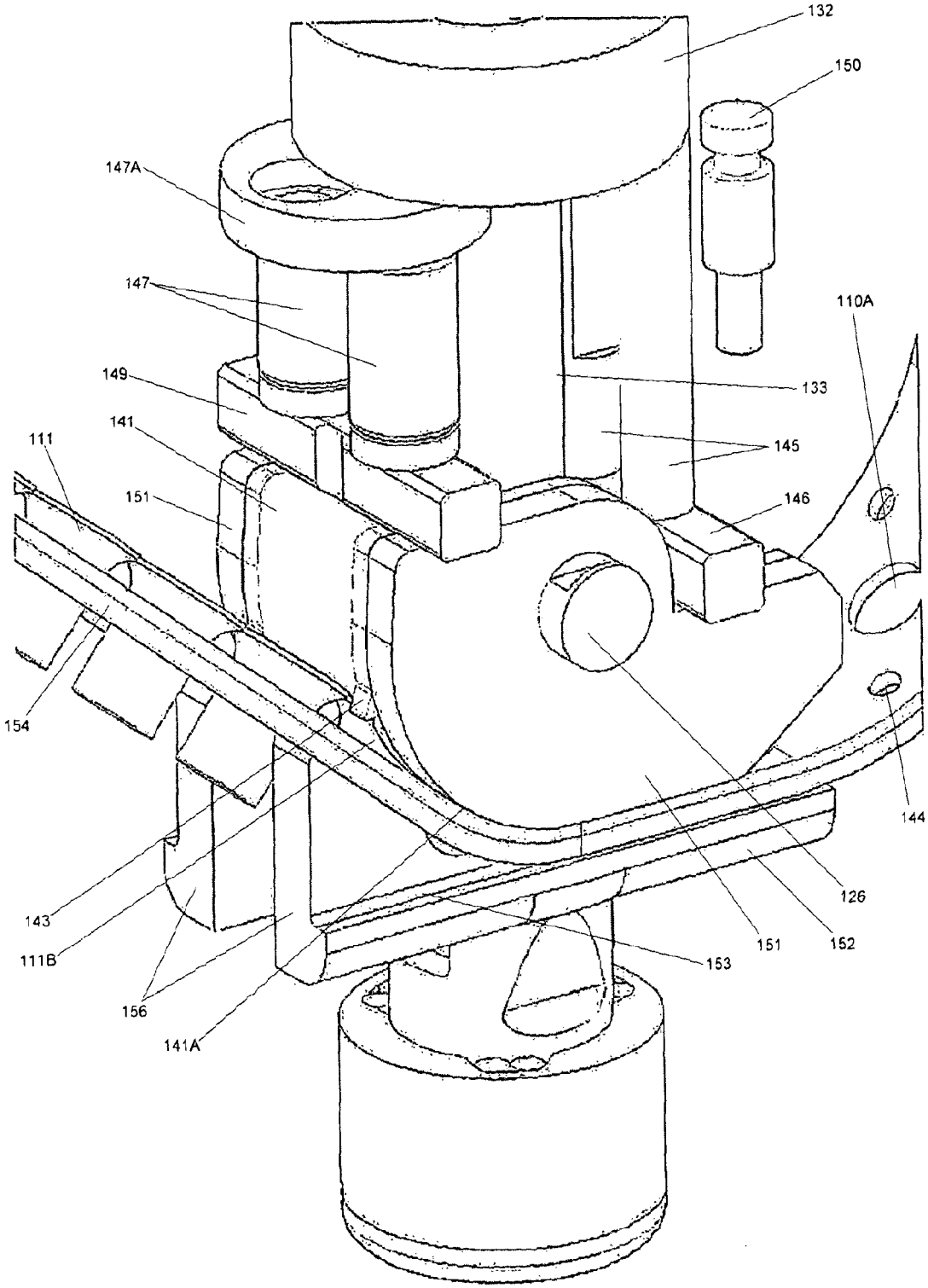
FIG. 16 is a perspective view of the fastener insertion apparatus shown in FIG. 15, but with a nose of the apparatus additionally depicted.

As shown in FIGS. 14 and 15, the pivot apertures 142 in the indexing arms 141 and rotatable tape retainers 151 may be slightly elongated so as to afford a small clearance relative to the pivot pins 126 that allowing the indexing arms 141 move slightly laterally of the pin as well as to rotate. This feature of the apertures 142 provides a dual advantage. Firstly, when the indexing arms 141 are rotated upstream by the actuators 145 the engagement of the teeth 143 and indexing holes 144 pushes the indexing arms 141, shifting them away from the tape 110 so as to help the teeth 143 clear the holes 144 in the tape 110. Secondly, when loading (or unloading) the tape 110 into (or out of) the apparatus 101, the indexing arm can be manually lifted clear of the feed path P so as to allow more easy insertion (or removal) of the tape 110.

So as to improve the reliability of insertion of rivets 111 by the apparatus 101, the nose 107 is provided with a plurality of bearings 157 which defined the passage 108. The bearings 157 are biased inwardly by one or more elastomeric members 158 such that a rivet 111 passing through the passage 108 is prevented from tumbling and is thus correctly inserted into the workpiece.

In operation, the fastener insertion apparatus 101 of the second embodiment functions according to the following sequence. A carrier tape 110 of rivets 111 is loaded such that a first rivet 111 is in position in the path of the punch 106 under the bore 103. A workpiece is positioned over the die 136 in the path of the punch 106 and the nose 107 brought into contact with the workpiece so as to retain it in place and optionally apply a desired clamping force at any stage before, during or after rivet insertion. The punch 106 translates axially downwards and the punch rod 133 strikes the rivet 111A, driving it out of the tape 110, down the passage 108 and into the workpiece. The punch rod 133 occupying the hole 110A in the tape 110 prevents further movement of the tape until the punch 106 retracts and is withdrawn from the tape 110 later in the cycle.

During descent of the punch rod 133 to drive the rivet 111A from the tape 110, the piston head 132 strikes the actuators 145, pushing the actuators 145 downwardly. The actuators 145 push the indexing arms 141, causing them to rotate and move the teeth 143 in an upstream direction, thereby compressing the compression springs 147 as described above. The teeth 143 leave the indexing holes 144 and proceed upstream beyond the next set of holes 144. At this point, the apparatus 101 is as shown in FIG. 15 (workpiece and die 136 not shown). The punch 106 then retracts. Although the piston head 132 has withdrawn away from the actuators 145, the indexing arms 141 and the compression springs 147 are held under tension until the punch rod 133 has released the tape 110. Once the punch rod 133 is withdrawn from the tape 110, the mechanism is returned to its original position by the extension of the compression springs 147. The return movement of the arms 141 causes the teeth 143 to travel downstream and towards the tape 110 engaging the edges of the next holes 144 and driving the tape in a downstream direction. The return movement of the indexing arms 141 is limited by the stop member 150 (as shown in FIG. 14), which is positioned such that, at the point at which the indexing arm 141 stops, the tape 110 has been fed downstream to the point that the next rivet 111B is in position in the path of the punch 106. The insertion sequence is then repeated so as to insert this next rivet 111B into the workpiece. It will be appreciated that, in the event that there is a problem such as an irregularity in the tape 110, the abutment surface 105B prevents overfeeding of the rivet 111 past alignment with the punch 106.

Figure 17:
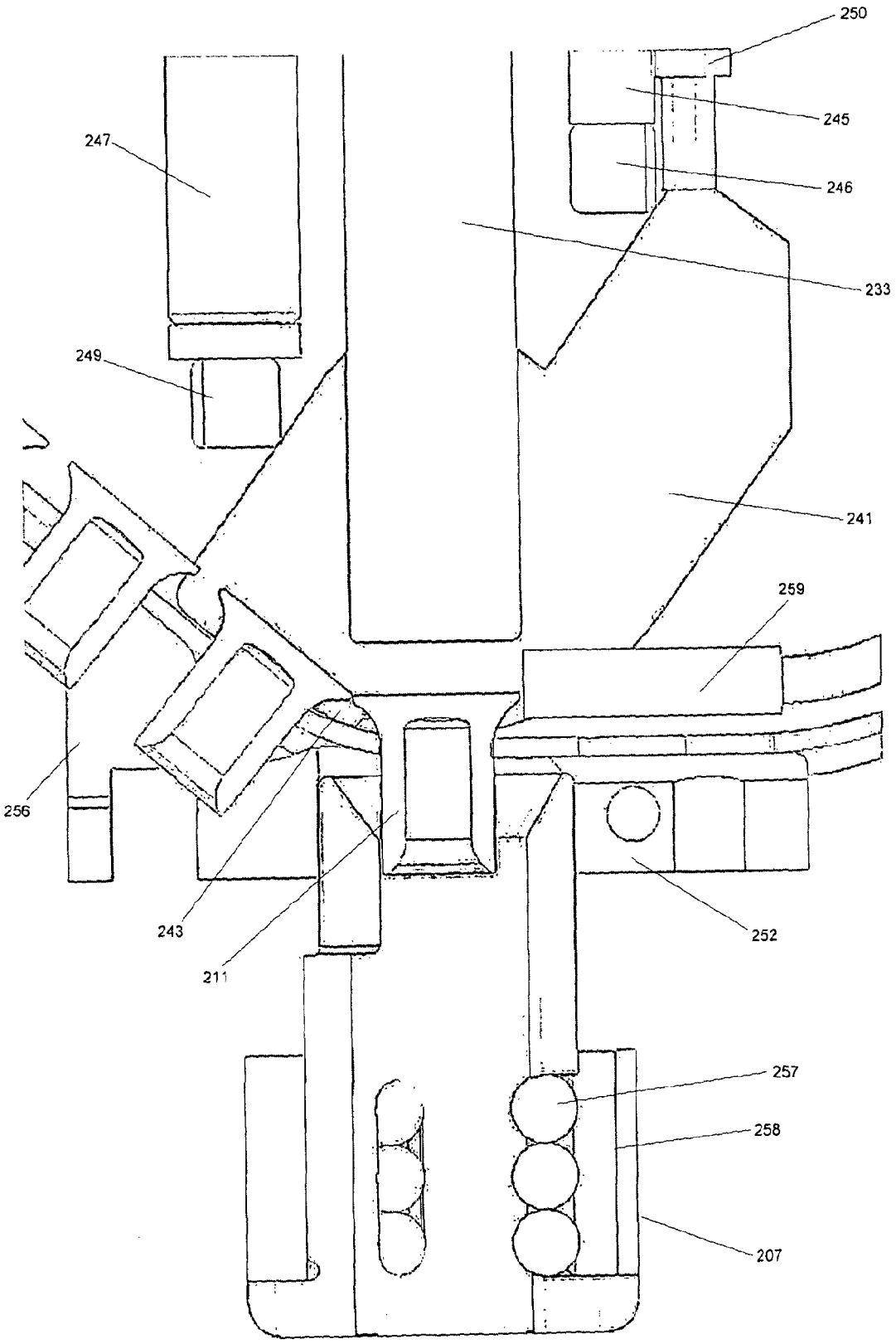
FIG. 17 is a sectioned side view of a third embodiment of part of a fastener insertion apparatus in accordance with the present invention, the body not being shown for clarity.

In a third embodiment, shown in FIG. 17, the fastener insertion apparatus 201 has all of the features of the fastener insertion apparatus of the second embodiment but has a sensor 259 provided adjacent to the position of a rivet 211 in the path of the punch 206. This sensor detects the presence or absence (or, more generally, the position) of the next rivet 211 on the tape 210. The sensor 259 is connected to a control system (not shown) such that, in the event that a rivet 211 is not correctly aligned with the punch 206 or is missing, the sensor 259 detects this and the control system stops the apparatus 201. This helps to prevent damage to the apparatus 201 but most importantly prevents the apparatus 201 from performing a rivet insertion cycle when there is no rivet 211 in the path of the punch 206, which greatly increases the likelihood that every fastening action of the apparatus 201 results in a rivet 211 being inserted in the expected place into the workpiece. This is advantageous in that there is a greater certainty that individual workpieces have been fastened correctly.

Figure 18:
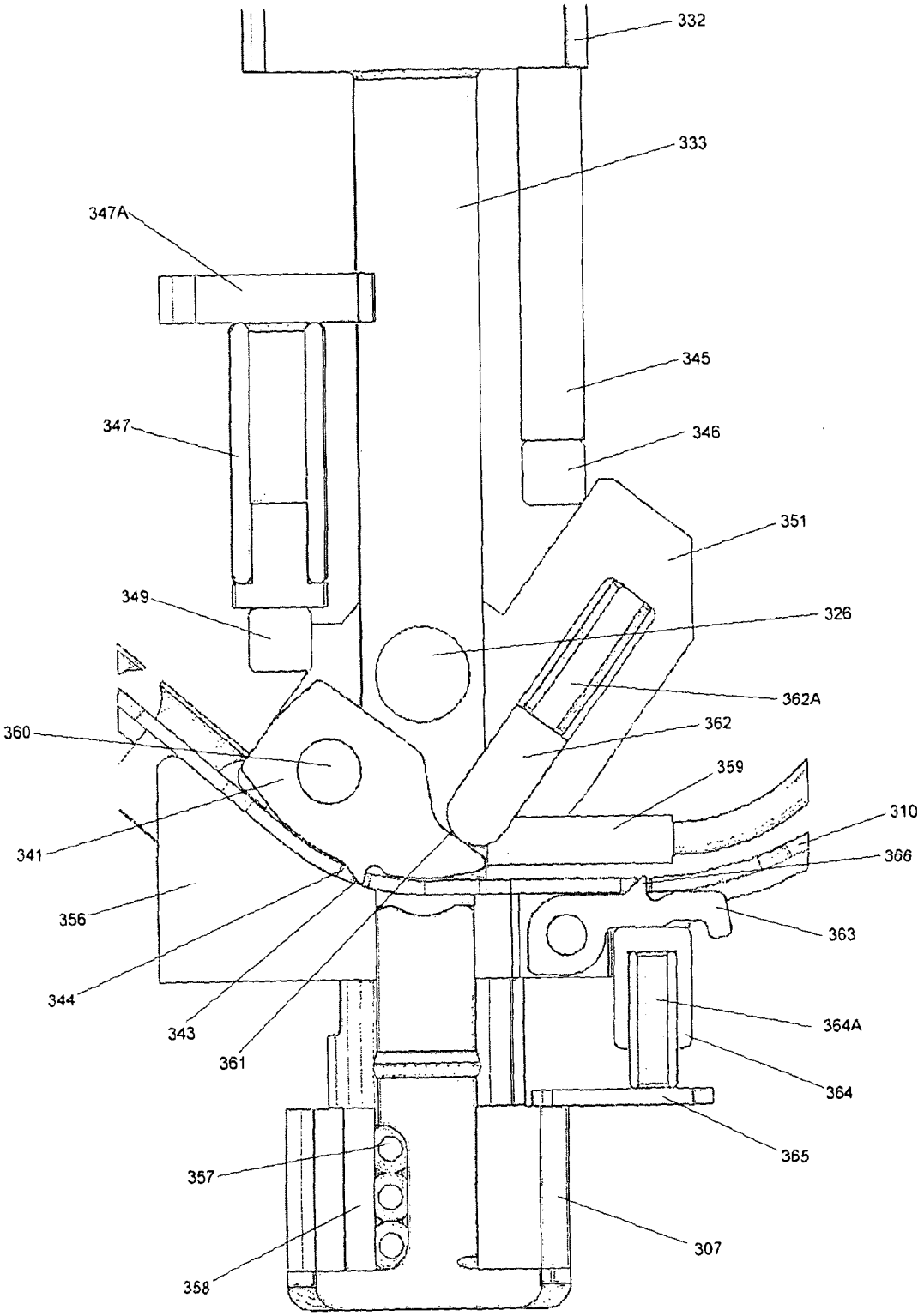
FIG. 18 is a sectioned side view of a fourth embodiment of a fastener insertion apparatus in accordance with the present invention, the body not being shown to expose the feeding device.
Figure 19:
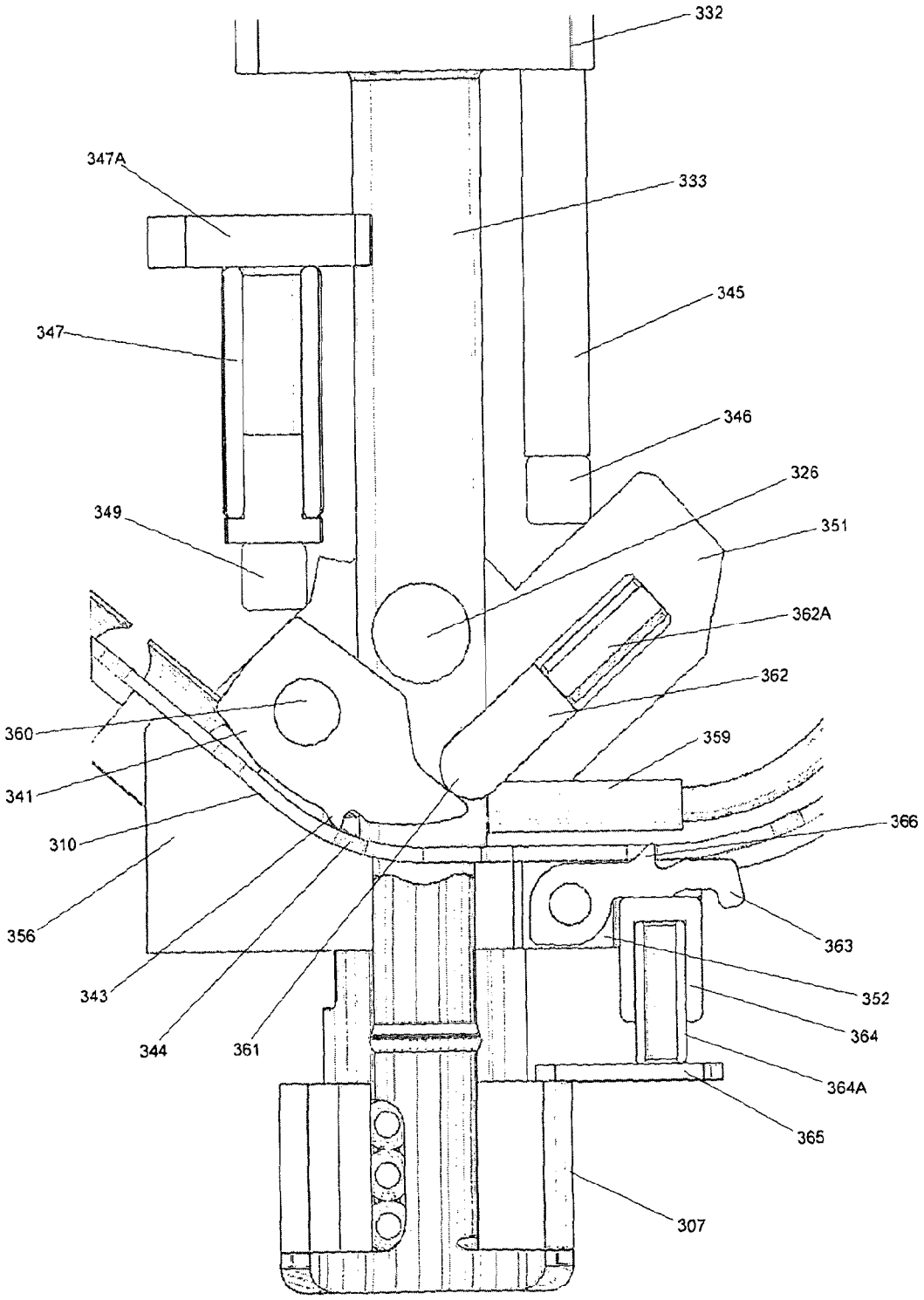
FIG. 19 shows the fastener insertion apparatus of FIG. 18 wherein the feeding device is in a partially rotated state.
Figure 20:
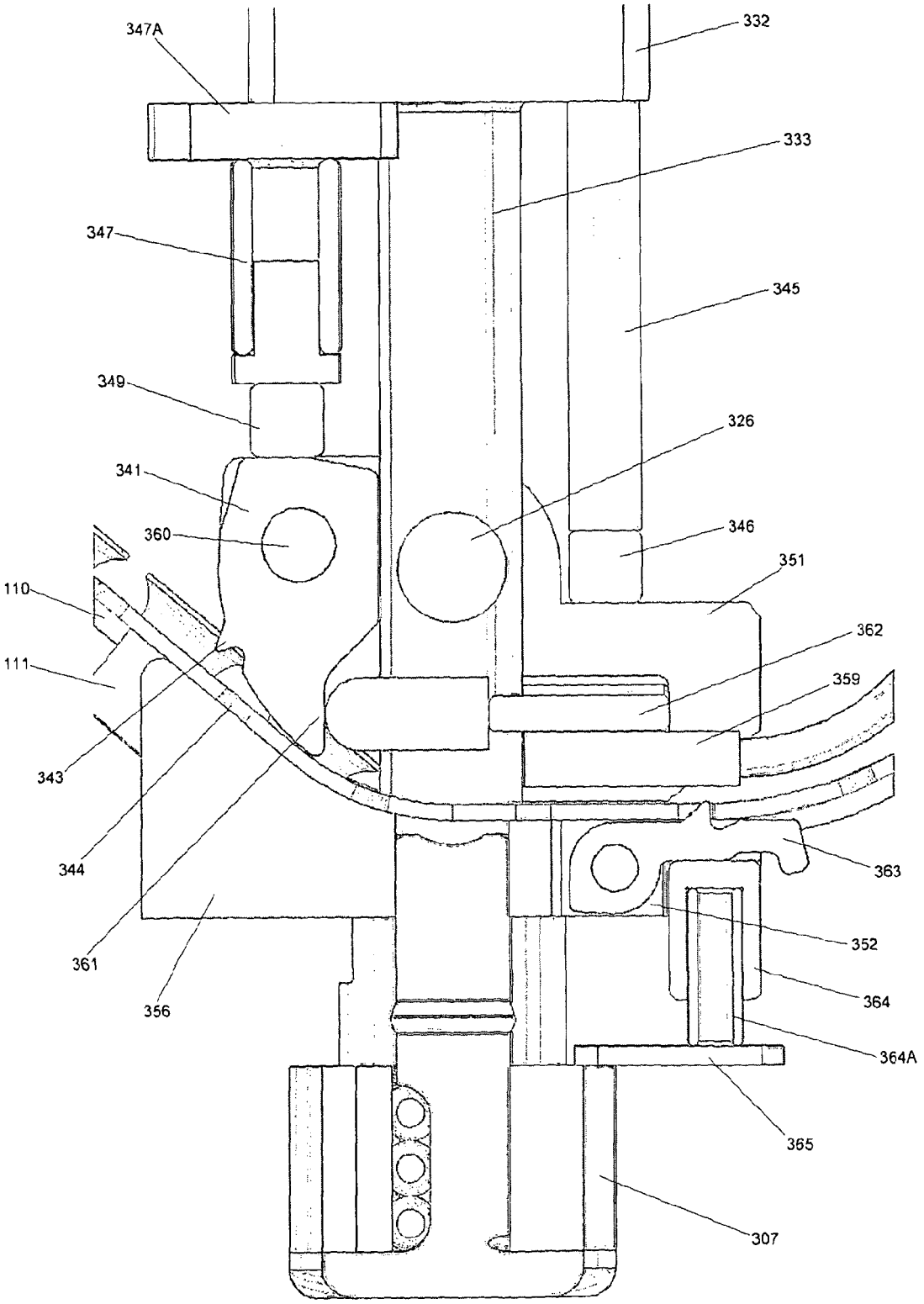
FIG. 20 shows the fastener insertion apparatus of FIG. 18 wherein the feeding device is in a fully rotated state.

A fourth embodiment of a fastener insertion apparatus 301 in accordance with the present invention is shown in FIGS. 18 to 20. The principal difference of the fourth embodiment from the second embodiment is that, the indexing arms 341 are smaller, and are rotatably mounted on the rotatable tape guides 351 rather then being directly mounted on to the body B of the feeder assembly 302B via a pivot pin 26,126,226 as in previous embodiments. The rotatable tape guides 351 are mounted on primary pivot pins 326 and interact with the actuators 345 and compression springs 147 in functionally the same way that the indexing arms 141 of the second embodiment interact with the actuators 145 and compression springs 147. Each indexing arm 341 is mounted on one of the rotatable tape guides 351 via a secondary pivot pin 360 defined on the interior surface of the rotatable tape retainer 351 at a location upstream of the pivot pin 326. For clarity and ease of understanding only one of each of the indexing arms 341 and the tape guides 351 are shown. More specifically, an indexing arm 141 in the foreground is depicted and obscures its counterpart which is immediately behind in the background, whereas only the tape retainer 351 in the background is shown, the foreground retainer 351 being removed so that the indexing arm 141 can be seen. Each indexing arm 341 is rotatably mounted at its first end, and at its opposite end comprises a lower edge (remote from the primary pivot pins 326) which defines a tooth 343 and an upper edge opposite the lower edge which defines a bearing surface 361 for contact with a plunger 362 biased by a spring 362A (only the foreground pair are shown) which is compressed between the plunger and the rotatable tape guide 351. The tooth 343 defined on each indexing arm 341 is thus biased into the hole 344 in the tape 310 when the rotatable tape guide 351 has not been moved by the actuators 345. Accordingly, in use, as shown in FIG. 18, at an initial position the teeth 343 of the two indexing arms 341 are biased into the indexing holes 344 in the tape in generally the same way that the teeth 143 engage with the holes 144 as described in relation to the second embodiment above. When the punch 332,333 descends the head 332 acts on the actuators 345, as before. However, the actuators 345, in turn, act on the rotatable guides 351 instead of directly on the indexing arms 341 and the guides 351 are rotated about primary pins 326 as illustrated in FIG. 19. This movement serves to lift the secondary pins 230 and indexing arms 341 such that the teeth 343 lift clear of the holes 344.

Further movement of the guides 351 cause the indexing arms 341 to move to the position shown in FIG. 20 where the teeth 333 are clear of the upper surface of the tape 310, the springs 362A force the plunger 362 against the bearing surface 361, pushing the indexing arms 341 (and thus the teeth 343) to return to a retracted position ready for engagement with the next indexing holes 344. Retraction of the punch releases the guides 351 and allows the teeth 343 to engage in the next set of indexing holes 344 i.e. back to the position shown in FIG. 18, but with the tape having indexed forward along the path P. The arrangement is such that each tooth 343 is able to slide over the surface of the carrier tape until it is in register with a hole 344 whereupon it drops in. Moreover, the tooth is fully engaged in the hole 344 when the punch is retracted from the tape It will be appreciated that the indexing arm 341 could take any suitable form. In one alternative embodiment it may take the form of a flat torsional spring with an integral tooth.

A further difference in the fourth embodiment is that the elongate tape guide 352 is provided with a rotatably mounted locking member 363 downstream of the path of the punch 306, beneath the tape 310 and aligned with the indexing holes 344 in one side of the tape 310. The locking member 363 is biased upwardly against the tape by a compression spring 364A mounted on a support 365 projecting from the nose 307. The spring is covered by a cap 364 that bears against the locking member 363. The locking member 363 defines a tooth 366 on its upper edge for engagement with tape indexing holes 244. The tooth 366 has an oblique edge on its upstream side and an upstanding edge on its downstream side, such that movement of the tape 310 in the downstream direction pushes the locking member 363 downwards, compressing the spring 364A. Thus, the indexing holes 344 in the tape 310 index past the locking member 363 as the tape 310 moves downstream. The holes 344 in the tape 310 and the position of the locking member 363 are such that, when a rivet 311 in the tape 310 is in the path of the punch 106, the tooth 366 of the locking member 363 sits in an indexing hole 344 in the tape 310 and prevents reverse, upstream, movement of the tape 310 by engagement between the upstanding edge of the tooth 366 and the edge of the hole 344. This is advantageous in that during a punching action, even when the punch rod 333 is not pinning the tape 310 in position, the tape 310 cannot be pulled backwards through the apparatus 301 (for example, by the upstream movement of the indexing arm 341). It will be appreciated that the feature of a locking member 363 may advantageously be added to any of the other embodiments.

The embodiments of FIGS. 9 to 20 all have a feed assembly that engages the tape in order to index it along the feed path P. This is beneficial in applications where very short rivets are present in the carrier tape since such rivets do not lend themselves to engagement by elements such as the catcher of the first embodiment. Moreover, the arrangement allows the very last rivet in the tape to be indexed into position automatically.

The indexing is performed by an indexing mechanism that disengages and re-engages with the tape or the fasteners as compared to conventional sprocket drives in which the drive is permanently engaged.

It will be appreciated that numerous modifications to the described embodiment may be made without departing from the scope of the invention as defined by the appended claims. In particular, it will be apparent that the fastener feed assembly or mechanism comprising a spring biased actuator and a pair of catchers or indexing arms may be replaced by any desirable mechanism provided that actuation occurs as a result of the movement of the punch relative to the guide bush and/or feed assembly. The actuator is provided within the guide bush or feed assembly so as to allow the guide bush or feed assembly to guide and support more of the range of movement of the punch. It will be appreciated that many of the features described in relation to different embodiments might be incorporated, individually or in combination, into a single embodiment of a fastener insertion apparatus in accordance with the present invention.

While the invention has been illustrated and described in detail in the drawings and foregoing description, the same is to be considered as illustrative and not restrictive in character, it being understood that only the preferred embodiments have been shown and described and that all changes and modifications that come within the scope of the inventions as defined in the claims are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. Fastener dispensing apparatus for dispensing fasteners, comprising:

a body in which a punch path is defined;

a punch at least partially within the punch path, the punch being reciprocally moveable between a retracted position and an advanced position in which the punch extends from an end of the punch path in order to drive a fastener towards a dispensed position;

a fastener feed path extending transverse to the punch path, the fastener feed path being arranged for receipt of an elongate carrier of fasteners; and a fastener feeding device for feeding the elongate carrier along the fastener feed path such that fasteners are sequentially brought into alignment with the end of the punch path, the fastener feeding device comprising an actuator moveable relative to the body by the reciprocal movement of the punch and at least one engagement member for engaging the elongate carrier or a fastener in the elongate carrier, the at least one engagement member being moveable relative to the body in response to movement of the actuator;

wherein the fastener feed path is defined at least in part by a surface of the body;

the actuator is engaged by part of the punch in order to effect movement in the fastener dispensing apparatus, the engagement of the punch with the actuator causing translational movement of the actuator substantially parallel to the punch path; and the at least one engagement member is reciprocally moveable between a retracted position in which the engagement member is disengaged from the elongate carrier or the fasteners therein, and an advanced position in which the elongate carrier is advanced so as to bring one of the fasteners in the carrier into alignment with the end of the punch path.

2. The fastener dispensing apparatus of claim 1, wherein the actuator is provided within the body.

3. The fastener dispensing apparatus according to claim 1, wherein there is provided a nose for engagement with a workpiece into or onto which the fastener is dispensed, the nose having a fastener delivery passage therethrough for delivery of the fastener to the workpiece after the fastener has been removed from the elongate carrier by the punch, the fastener feed path being defined at least in part by a clearance between the nose and the body, the nose being fixed relative to the body.

4. The fastener dispensing apparatus according to claim 1, wherein the punch has a first portion at least a part of which that extends from the punch path in the advanced position and a second portion, the actuator being moveable by the second portion of the punch.

5. The fastener dispensing apparatus according to claim 4, wherein the actuator is engaged by the second portion of the punch in order to effect movement in the fastener feeding device.

6. The fastener dispensing apparatus according to claim 1, wherein the actuator is biased towards a first position by a biasing member and is moveable against a biasing force by movement of the punch.

7. The fastener dispensing apparatus of claim 6, wherein the biasing member is provided on substantially the opposite side of the punch path to the actuator.

8. The fastener dispensing apparatus according to claim 1 wherein the actuator is mechanically coupled to the at least one engagement member.

9. The fastener dispensing apparatus according to claim 1 wherein the at least one engagement member pivots about a pivot axis which intersects the body.

10. The fastener dispensing apparatus according to claim 9, wherein the actuator is biased by a biasing member, the actuator being offset from the pivot axis on one side and the biasing member being offset from the pivot axis on an opposite side.

11. The fastener dispensing apparatus according to claim 1, wherein the at least one engagement member pivots about a pivot axis which intersects the punch path.

12. The fastener dispensing apparatus according to claim 1, wherein the body has a bore that defines the punch path.

13. The fastener dispensing apparatus according to claim 12, wherein the punch is supported along the length of the punch by the body as the punch reciprocates in the bore along the punch path.

14. The fastener dispensing apparatus according to claim 1, wherein the punch path defines a punch path axis along which the punch reciprocates and from which the punch extends to intersect the fastener feed path, the at least one engagement member being moveable relative to punch axis.

15. The fastener dispensing apparatus according to claim 1, wherein the at least one engagement member is external to the body.

16. The fastener dispensing apparatus of claim 1 wherein the at least one engagement member comprises a first portion which extends alongside the body and a second portion which occupies the fastener feed path.

17. The fastener dispensing apparatus of claim 1 wherein the at least one engagement member is mounted on the body.

18. The fastener dispensing apparatus of claim 1 wherein the at least one engagement member engages the elongate carrier.

19. The fastener dispensing apparatus of claim 18 wherein the engagement member comprises a main element and an engagement element moveable relative to the main element.

20. The fastener dispensing apparatus of claim 19, wherein the engagement element is moveably mounted on the main element.

21. The fastener dispensing apparatus of claim 19, wherein the engagement member comprises a further biasing member, the further biasing member configured, in use, to bias the engagement element towards engagement with the elongate carrier.

22. The fastener dispensing apparatus of claim 1, wherein the at least one engagement member engages a fastener supported in the elongate carrier.

23. The fastener dispensing apparatus of claim 22, wherein the at least one engagement member comprises an abutment surface such that, in use, the abutment surface abuts at least one of the fasteners supported in the elongate carrier so as to sequentially feed the fasteners into alignment with the end of the bore.

24. The fastener dispensing apparatus of claim 23, wherein the engagement member comprises a tapered surface such that, in use, abutment of the tapered surface against at least one further fastener deflects the at least one engagement member around the fastener.

25. The fastener dispensing apparatus according to claim 1, wherein the body comprises a guide bush for supporting the punch.

26. The fastener dispensing apparatus according claim 1, wherein the body is detachably connected to a guide bush that receives an upper part of the punch.

27. The fastener dispensing apparatus of claim 1, wherein the apparatus further comprises a locking member engageable with the elongate carrier such that, in use, the locking member prevents reverse movement of the elongate carrier along the fastener feed path when a fastener is in the path of the punch.

28. The fastener dispensing apparatus of claim 1, wherein the body defines an abutment surface in the fastener feed path, the abutment surface serving, in use, to prevent fasteners from being fed past the punch path and thus misaligned.

29. The fastener dispensing apparatus according to claim 1, wherein the fastener feed path is defined in the body.

30. The fastener dispensing apparatus according to claim 1, wherein the fastener feed path is defined at one end of the body.

31. The fastener dispensing apparatus of claim 1 wherein the locking member is downstream of the path of the punch.

32. Fastener dispensing apparatus for dispensing fasteners comprising:

a body through which a punch path is defined;

a punch at least partially within the punch path, the punch being reciprocally moveable between a retracted position and an advanced position in which the punch extends from an end of the punch path in order to contact a fastener and drive the fastener towards a dispensed position, the body defining a support surface that extends alongside the punch path and supports the punch during the movement of the punch along the punch path from the retracted to the advanced position;

a fastener feed path extending transverse to the punch path, the fastener feed path being arranged for receipt of an elongate carrier of fasteners, the punch path extending to the fastener feed path and the punch intersecting the fastener feed path in the advanced position; and a fastener feeding device for feeding the elongate carrier along the fastener feed path such that fasteners are sequentially brought into alignment with the end of the punch path, the fastener feeding device comprising an actuator moveable relative to the body by the reciprocal movement of the punch and at least one engagement member for engaging the elongate carrier or a fastener in the elongate carrier, the at least one engagement member being moveable relative to the support surface;

wherein the actuator is engaged by a part of the punch in order to effect movement in the fastener dispensing apparatus, the engagement of the punch with the actuator causing translational movement of the actuator substantially parallel to the punch path; and the at least one engagement member is reciprocally moveable between a retracted position in which the engagement member is disengaged from the elongate carrier or the fasteners therein, and an advanced position in which the elongate carrier is advanced so as to bring one of the fasteners in the carrier into alignment with the end of the punch path.

33. The fastener dispensing apparatus of claim 32 wherein the support surface is an internal surface of a bore defined through the body.

34. The fastener dispensing apparatus of claim 32, wherein a further surface of the body defines a portion of the fastener feed path.

35. The fastener dispensing apparatus according to claim 32, wherein the apparatus is configured to insert a fastener into a workpiece, whereby in the advanced position the punch drives the fastener towards the workpiece for insertion therein.

36. The fastener dispensing apparatus of claim 32 wherein the locking member is downstream of the path of the punch.

* * * * *